US012612275B2

(12) United States Patent
Sakai

(10) Patent No.: US 12,612,275 B2
(45) Date of Patent: Apr. 28, 2026

(54) MEDIUM CONVEYANCE APPARATUS WITH A PLURALITY OF SOUND WAVE SENSORS DRIVEN BY SINGLE DRIVE SIGNAL AND OUTPUTTING SOUND WAVE SIGNALS AT DIFFERENT TIMINGS

(71) Applicant: PFU LIMITED, Kahoku (JP)

(72) Inventor: Masaaki Sakai, Kahoku (JP)

(73) Assignee: PFU LIMITED, Kahoku (JP)

( * ) Notice: Subject to any disclaimer, the term of this patent is extended or adjusted under 35 U.S.C. 154(b) by 190 days.

(21) Appl. No.: 18/467,561

(22) Filed: Sep. 14, 2023

(65) Prior Publication Data

US 2024/0132315 A1 Apr. 25, 2024
US 2024/0228209 A9 Jul. 11, 2024

(30) Foreign Application Priority Data

Oct. 20, 2022 (JP) ..... 2022-168403

(51) Int. Cl.
*B65H 7/12* (2006.01)
*B65H 5/06* (2006.01)

(52) U.S. Cl.
CPC ..... *B65H 7/125* (2013.01); *B65H 5/062* (2013.01)

(58) Field of Classification Search
CPC ..... B65H 7/125; B65H 2511/524; B65H 2553/30
See application file for complete search history.

(56) References Cited

U.S. PATENT DOCUMENTS 6,947,851 B2 * 9/2005 Jespersen ..... G01F 1/667 73/861.31
8,531,742 B2 * 9/2013 Tanaka ..... B65H 3/063 271/262
8,657,285 B2 * 2/2014 Matsuoka ..... B65H 5/06 271/262
8,931,777 B2 * 1/2015 Okitsu ..... B65H 7/125 271/262
2004/0100018 A1 5/2004 Phinney et al.
2008/0277860 A1 * 11/2008 Chen ..... B65H 7/12 271/3.17

FOREIGN PATENT DOCUMENTS

JP 2004-175570 A 6/2004

* cited by examiner

*Primary Examiner* — Howard J Sanders
(74) *Attorney, Agent, or Firm* — Womble Bond Dickinson (US) LLP

(57) ABSTRACT

A medium conveyance apparatus includes a drive signal output circuit to output a drive signal at a predetermined timing, a first sound wave emitter to output a sound wave based on the drive signal outputted at the predetermined timing, a first sound wave receiver to output a first sound wave signal corresponding to the received sound wave, a second sound wave emitter to output a sound wave based on the drive signal outputted at the predetermined timing, a second sound wave receiver to output a second sound wave signal corresponding to the received sound wave, a processor to determine a state of the medium based on the first sound wave signal and the second sound wave signal, and an output circuit to output the first sound wave signal and the second sound wave signal to the processor at timings different from each other.

20 Claims, 13 Drawing Sheets

MEDIUM CONVEYANCE APPARATUS WITH A PLURALITY OF SOUND WAVE SENSORS DRIVEN BY SINGLE DRIVE SIGNAL AND OUTPUTTING SOUND WAVE SIGNALS AT DIFFERENT TIMINGS

CROSS-REFERENCE TO RELATED APPLICATIONS

This application is based upon and claims the benefit of priority of prior Japanese Patent Application No. 2022-168403, filed on Oct. 20, 2022, the entire contents of which are incorporated herein by reference.

TECHNICAL FIELD

Embodiments discussed in the present specification relate to conveyance of a medium.

BACKGROUND

A medium conveyance apparatus including a scanner that captures an image of a medium while conveying is required to suitably determine the position of the medium to suitably capture the front end to the rear end of the medium. Further, in general, the medium conveyance apparatus has the function of detecting whether multi-feed, in which a plurality of sheets of the medium are conveyed in an overlapped manner, has occurred, and automatically stopping conveyance of the medium when multi-feed has occurred.

A device for detecting a plurality of documents in a document conveyance system is known. The device includes a first transmitter to emit a first signal during a first interval, a first sensor to detect the first signal, a second transmitter to emit a second signal during a second interval, and a second sensor to detect the second signal.

SUMMARY

According to some embodiments, a medium conveyance apparatus includes a conveying roller to convey a medium along a conveyance path, a drive signal output circuit to output a drive signal at a predetermined timing, a first sound wave emitter to output a sound wave including at least an audible sound or ultrasonic wave based on the drive signal outputted at the predetermined timing, a first sound wave receiver located to face the first sound wave emitter with the conveyance path in between to output a first sound wave signal corresponding to a received sound wave, a second sound wave emitter to output a sound wave including at least an audible sound or ultrasonic wave based on the drive signal outputted at the predetermined timing, a second sound wave receiver located to face the second sound wave emitter with the conveyance path in between to output a second sound wave signal corresponding to a received sound wave, a processor to determine a state of the medium based on the first sound wave signal and the second sound wave signal, and an output circuit to output the first sound wave signal and the second sound wave signal to the processor at timings different from each other.

According to some embodiments, a medium conveyance method includes determining a state of a medium based on a first sound wave signal output corresponding to a received sound wave by a first sound wave receiver located to face a first sound wave emitter to output a sound wave including at least an audible sound or ultrasonic wave based on a drive signal outputted at a predetermined timing by a drive signal output circuit with a conveyance path in between, and a second sound wave signal output corresponding to a received sound wave by a second sound wave receiver located to face a second sound wave emitter to output a sound wave including at least an audible sound or ultrasonic wave based on the drive signal outputted at the predetermined timing by the drive signal output circuit with the conveyance path in between. an output circuit to output the first sound wave signal and the second sound wave signal to the processor at timings different from each other. The first sound wave signal and the second sound wave signal are outputted at timings different from each other by an output circuit.

According to some embodiments, computer-readable, non-transitory medium stores executable instructions for conveying a medium. The executable instructions includes determining a state of a medium based on a first sound wave signal output corresponding to a received sound wave by a first sound wave receiver located to face a first sound wave emitter to output a sound wave including at least an audible sound or ultrasonic wave based on a drive signal outputted at a predetermined timing by a drive signal output circuit with a conveyance path in between, and a second sound wave signal output corresponding to a received sound wave by a second sound wave receiver located to face a second sound wave emitter to output a sound wave including at least an audible sound or ultrasonic wave based on the drive signal outputted at the predetermined timing by the drive signal output circuit with the conveyance path in between. The first sound wave signal and the second sound wave signal are outputted at timings different from each other by an output circuit.

DESCRIPTION OF EMBODIMENTS

It is to be understood that both the foregoing general description and the following detailed description are exemplary and explanatory, and are not restrictive of the invention, as claimed.

Hereinafter, a medium conveyance apparatus, medium conveyance method and computer-readable, non-transitory medium according to an embodiment, will be described with reference to the drawings. However, it should be noted that the technical scope of the invention is not limited to these embodiments and extends to the inventions described in the claims and their equivalents.

Figure 1:
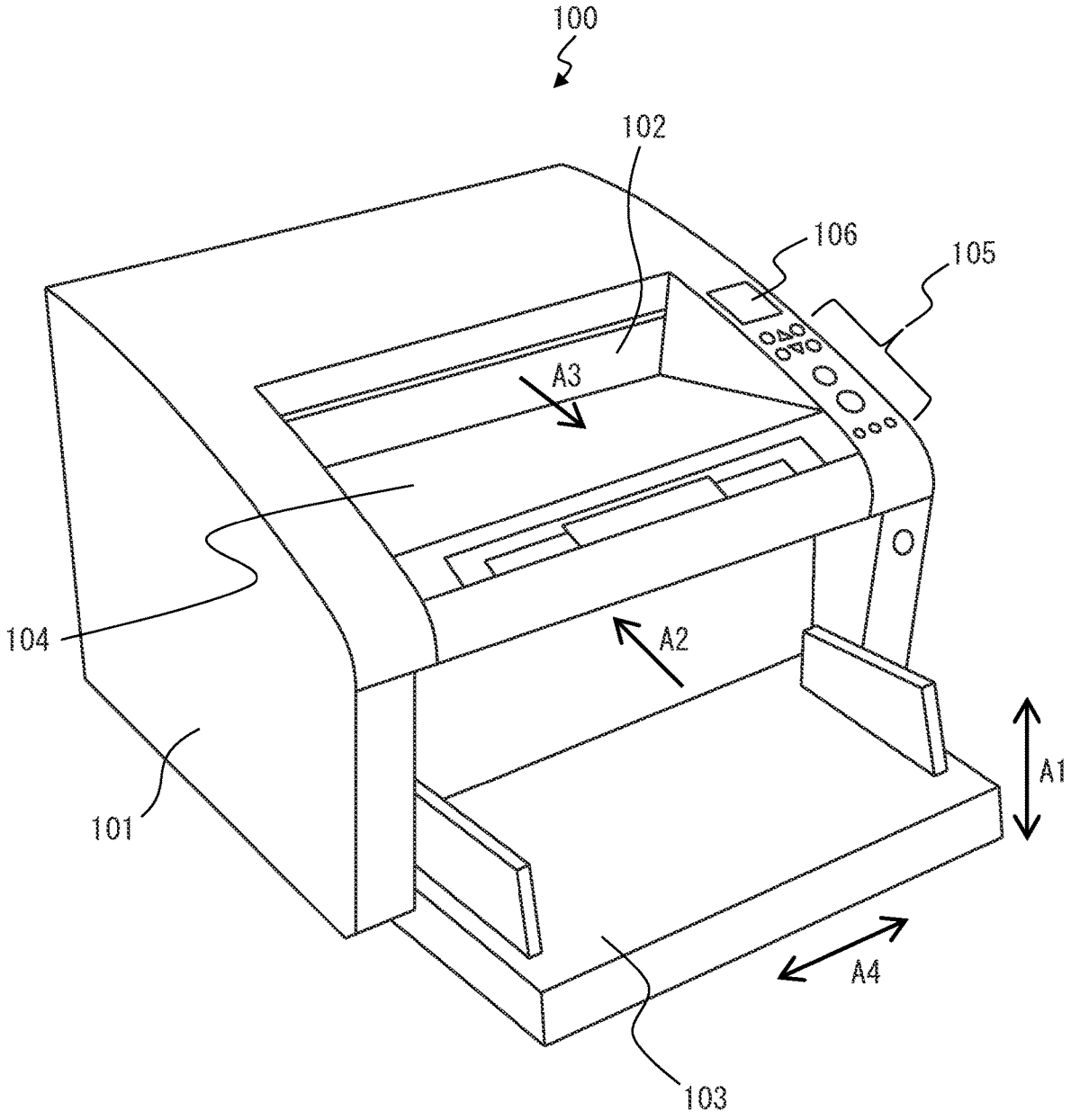
FIG. 1 is a perspective view illustrating a medium conveyance apparatus according to an embodiment.

FIG. 1 is a perspective view illustrating an example of a medium conveyance apparatus constituted as an image scanner. The medium conveyance apparatus 100 conveys a document as a medium and captures an image of it. The medium is paper, etc. Further, "medium" includes media to which labels (seals) or small pieces of paper (photographs, cuttings, postal stamps, revenue stamps, etc.) and other attachments are adhered. The medium feed apparatus 100 may be a facsimile, copier, multifunction peripheral (MFP), etc. The medium being conveyed may be a print object etc., rather than a document and the medium conveyance apparatus 100 may be a printer etc.

The medium conveyance apparatus 100 includes a first housing 101, second housing 102, stacking tray 103, ejection tray 104, operating device 105, display device 106, etc.

The second housing 102 is located at the upper side of the medium conveyance apparatus 100 and engages with the first housing 101 by hinges to be able to be opened and closed at the time of medium jamming, the time of cleaning the inside of the medium conveyance apparatus 100, etc.

The stacking tray 103 engages with the first housing 101 to be able to stack the medium to be conveyed. The stacking tray 103 is provided at the side surface of the first housing 101 at the medium supply side movably in a substantially vertical direction (height direction) A1 by a motor. When not conveying the medium, the stacking tray 103 is located at the bottom so that the medium is easily stacked. When conveying the medium, the stacking tray 103 rises to a position where the medium stacked at the top contacts a pick roller. The ejection section 104 is formed on the second housing 102 to be able to hold the ejected medium and stack the ejected medium.

The operating device 105 has buttons or other input devices and an interface circuit acquiring signals from the input devices, receives input operations of a user, and outputs operating signals corresponding to the input operations of a user. The display device 106 has a display including liquid crystals, organic Electro-Luminescence (El), etc., and an interface circuit outputting image data to the display and displaying the image data on the display.

In FIG. 1, the arrow A2 indicates a medium conveyance direction, the arrow A3 indicates a medium ejection direction, and the arrow A4 indicates a width direction perpendicular to the medium conveyance direction. Hereinafter, "upstream" means upstream in the medium conveyance direction A2 or medium ejection direction A3, while "downstream" means downstream in the medium conveyance direction A2 or medium ejection direction A3.

Figure 2:
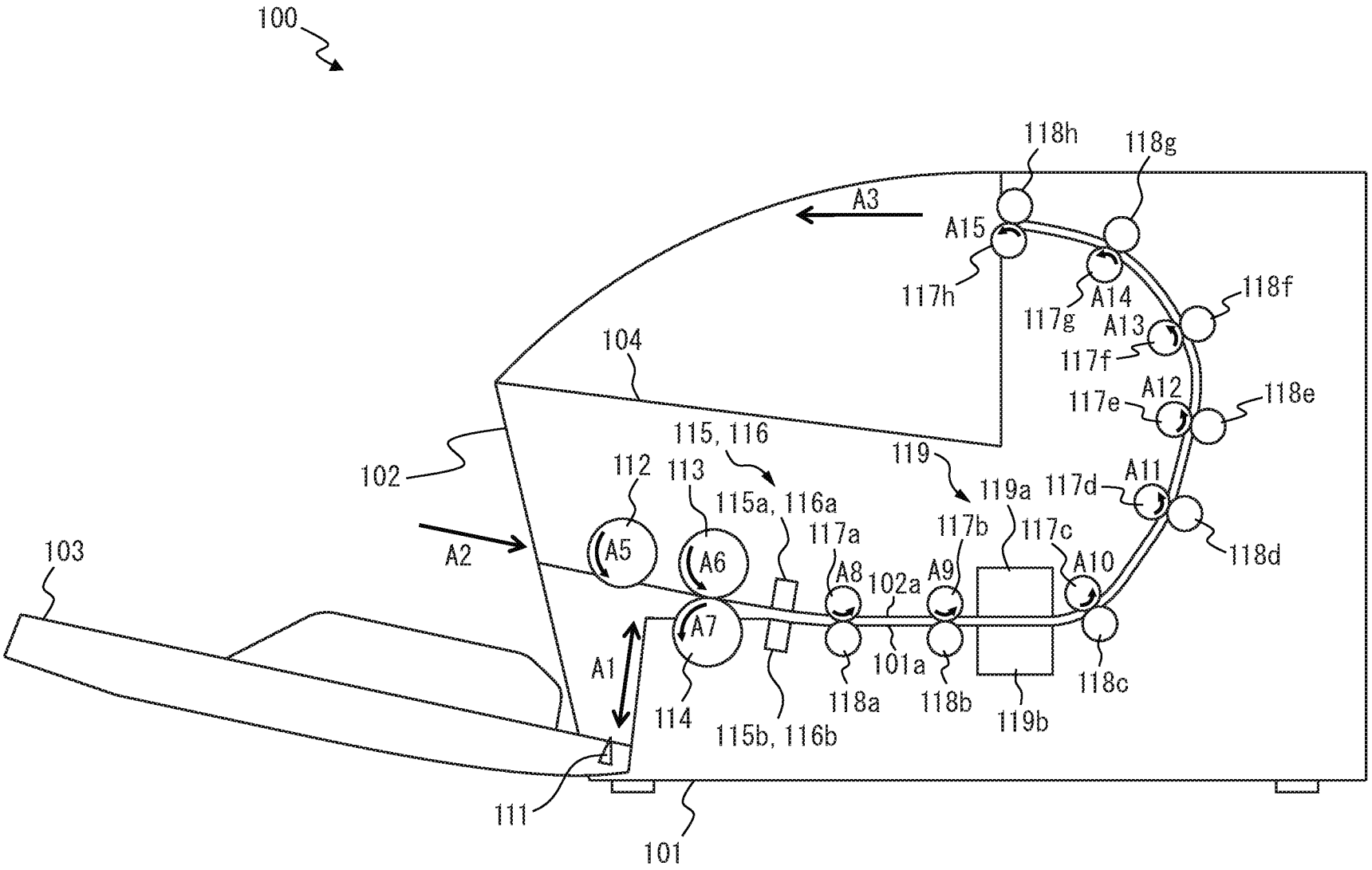
FIG. 2 is a view for explaining a conveyance route of an inside of the medium conveyance apparatus according to an embodiment.

FIG. 2 is a view for explaining an example of a conveyance path inside of an example of a medium conveyance apparatus.

The conveyance route inside the medium conveyance apparatus 100 has a medium sensor 111, pick roller 112, feed roller 113, separation roller 114, first sound wave sensor 115, second sound wave sensor 116, first to eighth conveyance rollers 117*a* to 117*h*, first to eighth driven rollers 118*a* to 118*h*. imaging device 119, etc.

The pick roller 112, feed roller 113, separation roller 114, first to eighth conveyance rollers 117*a* to 117*h*, and first to eighth driven rollers 118*a* to 118*h* are examples of the conveying unit and are located along the conveyance path of the medium and convey the medium along the conveyance path. The numbers of the pick roller 112, feed roller 113, separation roller 114, first to eighth conveyance rollers 117*a* to 117*h*, and/or first to eighth driven rollers 118*a* to 118*h* are not limited to one and may be plural. In this case, a plurality of pick rollers 112, feed rollers 113, separation rollers 114, first to eighth conveyance rollers 117*a* to 117*h*, and/or first to eighth driven rollers 118*a* to 118*h* are respectively located with spaced apart in the width direction A4.

The medium conveyance apparatus 100 has a so-called U-turn path. The surface of the first housing 101 facing the second housing 102 forms a first guide 101*a* of the medium conveyance path, while the surface of the second housing 102 facing the first housing 101 forms a second guide 102*a* of the medium conveyance path.

The medium sensor 111 is located at the stacking tray 103, i.e., at an upstream side of the feed roller 114 and separation roller 115 and detects the stacking state of the medium at the stacking tray 103. The medium sensor 111 determines whether the stacking tray 103 has the medium by a contact detection sensor which generates a predetermined current when the medium contacts it or when the medium does not contact it. The medium sensor 111 generates and outputs a first medium signal with a signal value changing between a state where the stacking tray 103 has the medium and a state where the stacking tray 103 has no medium. Note that the medium sensor 111 is not limited to a contact detection sensor. A photo detection sensor or any other sensor able to detect the presence of the medium may be used as the medium sensor 111.

The pick roller 112 is provided at the second housing 102, contacts the medium stacked on the stacking tray 103 which has risen to substantially the same height as the medium conveyance path, and feeds the medium toward the downstream side.

The feed roller 113 is provided inside the second housing 102 at the downstream side of the pick roller 112 and feeds the medium stacked on the stacking tray 103 and fed by the pick roller 112 toward the further downstream side. The separation roller 115 is located inside the first housing 101 facing the feed roller 114. The feed roller 114 and separation roller 115 performs separation of the medium and separate and feed the medium one sheet at a time. The feed roller 114 is located above the separation roller 115, and the medium conveyance apparatus 100 feeds the medium by the so-called top pick method.

The first sound wave sensor 115 and the second sound wave sensor 116 are located at the downstream side of the feed roller 113 and separation roller 114 and the upstream side of the first conveyance roller 117*a* and the first driven roller 118*a*. The first sound wave sensor 115 and the second sound wave sensor 116 are located aligned spaced apart in the width direction A4. The first sound wave sensor 115 and the second sound wave sensor 116 may also be located at the downstream side of the feed roller 113 and separation roller 114 and the upstream side of the eighth conveyance roller 117*h* and the eighth driven roller 118*h*. Further, the first sound wave sensor 115 and the second sound wave sensor 116 may also be located aligned spaced apart in the medium conveyance direction A2. The first sound wave sensor 115 and the second sound wave sensor 116 may also be located to have any positional arrangement.

The first sound wave sensor 115 includes a first sound wave emitter 115*a* and a first sound wave receiver 115*b*. The first sound wave emitter 115*a* and the first sound wave receiver 115*b* are located in the vicinity of the conveyance path of the medium to face each other with the conveyance path in between. The second sound wave sensor 116 includes a second sound wave emitter 116*a* and a second sound wave receiver 116*b*. The second sound wave emitter 116*a* and the second sound wave receiver 116*b* are located in the vicinity of the conveyance path of the medium to face each other with the conveyance path in between. Details of the first sound wave sensor 115 and the second sound wave sensor 116 will be explained later.

The first to eighth conveyance rollers 117*a* to 117*h* and the first to eighth driven rollers 118*a* to 118*h* are provided at the downstream side of the feed roller 113 and separation roller 114 and convey the medium fed by the feed roller 113 and separation roller 114 toward the downstream side. The first to eighth conveyance rollers 117*a* to 117*h* and the first to eighth driven rollers 118*a* to 118*h* are respectively located to face each other with the medium conveyance path in between.

The imaging device 119 is located at the downstream side of the second conveyance roller 117*b* and the second driven roller 118*b* and at the upstream side of the third conveyance roller 117*c* and the third driven roller 118*c*. The imaging device 119 may also be located at any position at the downstream side of the feed roller 113 and separation roller 114 and the upstream side of the eighth conveyance roller 117*h* and the eighth driven roller 118*h*. The imaging device 119 includes a first imaging device 119*a* and a second imaging device 119*b*. The first imaging device 119*a* and the second imaging device 119*b* are located in the vicinity of the conveyance path of the medium to face each other with the conveyance path in between.

The first imaging device 119*a* includes a line sensor based on a unity-magnification optical system type contact image sensor (CIS) including an imaging element based on a complementary metal oxide semiconductor (CMOS) linearly located in a main scanning direction. The first imaging device 119*a* also includes a lens for forming an image on the imaging element, and an A/D converter for amplifying and analog digital (A/D) converting an electric signal output from the imaging element. The first imaging device 119*a* images the front side of a medium being conveyed, generates an input image, and outputs it.

Similarly, the second imaging device 119*b* includes a line sensor based on a unity-magnification optical system type CIS including an imaging element based on a CMOS linearly located in the main scanning direction. The second imaging device 119*b* also includes a lens that form image on an imaging element, and an A/D converter for amplifying and analog-digital converting an electric signal output from the imaging element. The second imaging device 119*b* images the back side of a medium being conveyed, generates an input image, and outputs it.

The medium feed apparatus 100 may have only one of the first imaging device 119*a* and the second imaging device 119*b* and read only one surface of a medium. Further, instead of the line sensor based on a unity-magnification optical system type CIS including an imaging element based on a CMOS, a line sensor based on a unity-magnification optical system type CIS including an imaging element based on Charge Coupled Devices (CCDs) may be utilized. Further, a line sensor based on a reduction optical system type line sensor including an imaging element based on a CMOS or CCD may be utilized.

The medium stacked on the stacking tray 103 is conveyed between the first guide 101*a* and the second guide 102*a* toward the medium conveyance direction A2 by the pick roller 112 and the feed roller 113 respectively rotating in the medium feed directions A5, A6. On the other hand, when the stacking tray 103 has a plurality of sheets of the medium, only the sheet of the medium contacting the feed roller 113 in the medium stacked on the stacking tray 103 is separated by the separation roller 114 rotating in the opposite direction A7 to the medium feed direction.

The medium is sent to the imaging position of the imaging device 119 by being guided by the first guide 101*a* and the second guide 102*a* while the first to second conveyance rollers 117*a* to 117*b* rotate in the directions of the arrows A8 to A9 and is captured by the imaging device 119. Furthermore, the medium is ejected onto the ejection tray 104 by the third to the sixth conveyance rollers 117*c* to 117*h* respectively rotating in the directions of the arrows A10 to A15.

Figure 3:
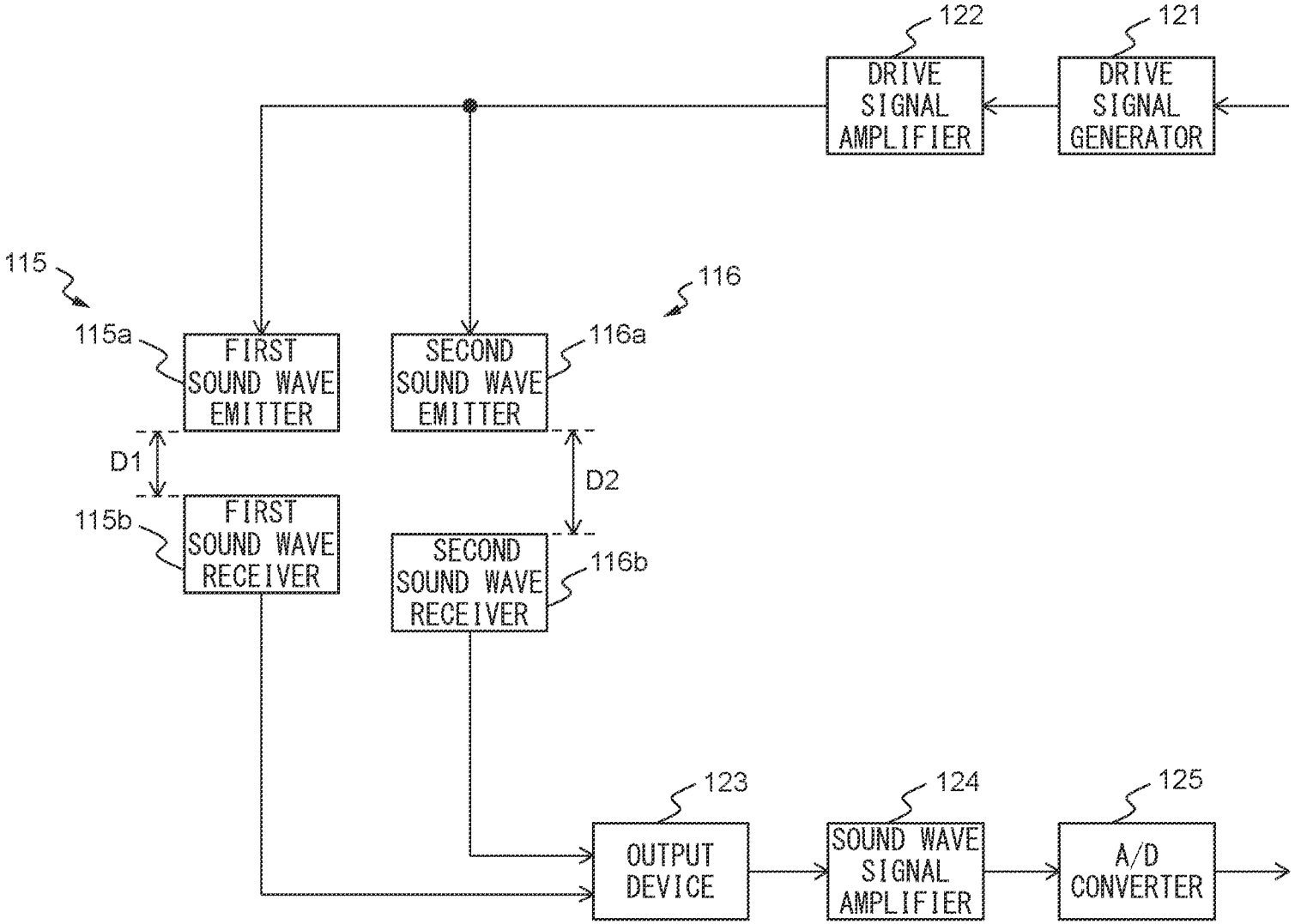
FIG. 3 is a schematic view for explaining a first sound wave sensor etc., according to an embodiment.

FIG. 3 is a schematic view for explaining a first sound wave sensor and a second sound wave sensor according to an embodiment.

As illustrated in FIG. 3, the medium conveyance apparatus 100 further has a drive signal generator 121, drive signal amplifier 122, output device 123, sound wave signal amplifier 124, A/D converter 125, etc.

The drive signal generator 121 includes a drive signal output circuit and outputs drive signals at predetermined timings. The drive signal generator 121 outputs the drive signals to the drive signal amplifier 122 under control from the later explained predetermined circuit. The drive signals are clock signals which change in ON/OFF state every certain time interval for driving the first sound wave emitter 115*a* and the second sound wave emitter 116*a*.

The drive signal amplifier 122 is one example of one amplifier and includes an amplifying circuit. The drive signal amplifier 122 amplifies the drive signals outputted from the drive signal generator 121 to output it to the first sound wave emitter 115*a* and the second sound wave emitter 116*a*.

The first sound wave emitter 115*a* includes a first sound wave emitting circuit. The first sound wave emitter 115*a* outputs a sound wave based on the drive signal outputted from the drive signal amplifier 122, i.e., based on the drive signal outputted from the drive signal generator 121 at a predetermined timing. The sound wave includes at least an audible sound or ultrasonic wave. The frequency of the audible sound is 20 Hz or more and 20 kHz or less, while the frequency of the ultrasonic wave is larger than 20 kHz and 300 MHz or less. The sound wave may further include a less than 20 Hz sound wave and/or a greater than 300 MHz sound wave. On the other hand, the first sound wave receiver 115*b* includes a first sound wave receiving circuit. The first sound wave receiver 115*b* receives the sound wave outputted by the first sound wave emitter 115*a* and passed through the medium and generates and outputs an electric signal corresponding to the received sound wave as a first sound wave signal. The first sound wave signal indicates the magnitude of the sound wave received by the first sound wave receiver 115*b*, i.e., the magnitude of the sound wave passing through the medium conveyed by the conveying unit. The first sound wave signal may indicate, in addition to or instead of the magnitude of the sound wave received by the first sound wave receiver 115*b*, the magnitude of the phase shift of the sound wave received by the first sound wave receiver 115*b* from the phase of the sound wave emitted by the first sound wave emitter 115*a*.

The second sound wave emitter 116*a* includes a second sound wave emitting circuit. The second sound wave emitter 116*a* outputs a sound wave based on the drive signal outputted from the drive signal amplifier 122, i.e., based on the drive signal outputted from the drive signal generator 121 at a predetermined timing. The sound wave includes an audible sound or ultrasonic wave. The frequency of the audible sound is 20 Hz or more and 20 kHz or less, while the frequency of the ultrasonic wave is larger than 20 kHz and 300 MHz or less. On the other hand, the second sound wave receiver 116*b* includes a second sound wave receiving circuit. The second sound wave receiver 116*b* receives a sound wave outputted by the second sound wave emitter 116*a* and passed through the medium and generates and outputs an electric signal corresponding to the received sound wave as a second sound wave signal. The second sound wave signal indicates the magnitude of the sound wave received by the second sound wave receiver 116*b*, i.e., the magnitude of the sound wave passing through the medium conveyed by the conveying unit. The second sound wave signal may indicate, in addition to or instead of the magnitude of the sound wave received by the second sound wave receiver 116*b*, the magnitude of the phase shift of the sound wave received by the second sound wave receiver 116*b* from the phase of the sound wave emitted by the second sound wave emitter 116*a*.

The first sound wave emitter 115*a* and the second sound wave emitter 116*a* output sound waves based on a common (same) drive signal outputted from the drive signal generator 121. As illustrated in FIG. 3, the distance D1 between the first sound wave emitter 115*a* and the first sound wave receiver 115*b* differs from the distance D2 between the second sound wave emitter 116*a* and the second sound wave receiver 116*b*. For this reason, the sound waves simultaneously outputted from the first sound wave emitter 115*a* and the second sound wave emitter 116*a* based on the same drive signal respectively reach the first sound wave receiver 115*b* and the second sound wave receiver 116*b* at different timings from each other. Therefore, the timing at which the first sound wave receiver 115*b* outputs the first sound wave signal and the timing at which the second sound wave receiver 116*b* outputs the second sound wave signal differ from each other.

For example, the sound wave sensors are located such that the difference between the distance D1 between the first sound wave emitter 115*a* and the first sound wave receiver 115*b* and the distance D2 between the second sound wave emitter 116*a* and the second sound wave receiver 116*b* is 5 mm or more. The timings at which the sound waves outputted from the sound wave emitters reach the sound wave receivers are off by exactly the value of the difference between the distance D1 and the distance D2 divided by the speed of sound, so the difference in time periods from when the sound wave emitters output the sound waves to when the sound wave receivers receive the sound waves is 10 pec or more. In other words, the time difference between the timing at which the first sound wave receiver 115*b* outputs the first sound wave signal based on a drive signal outputted at the predetermined timing and the timing at which the second sound wave receiver 116*b* outputs the second sound wave signal based on that drive signal is 10 pec or more. Therefore, the medium conveyance apparatus 100 can utilize each of the plurality of sound wave signals outputted by the plurality of sound wave receivers to determine the states of the medium at the respective positions of the plurality of sound wave sensors.

The output device 123 includes an output circuit. The output device 123 receives as input the first sound wave signal outputted from the first sound wave receiver 115*b* and the second sound wave signal outputted from the second sound wave receiver 116*b*. The output device 123 switches the signal to output either of the first sound wave signal outputted from the first sound wave receiver 115*b* and the second sound wave signal outputted from the second sound wave receiver 116*b*. In that way, the timing at which the first sound wave receiver 115*b* outputs the first sound wave signal and the timing at which the second sound wave receiver 116*b* outputs the second sound wave signal differ from each other, so the output device 123 receives the first sound wave signal and the second sound wave signal as input at different timings. The output device 123 is provided to output the first sound wave signal when the first sound wave signal is input and output the second sound wave signal when the second sound wave signal is input. In the above example, the time difference between the timing at which the first sound wave signal is input to the output device 123 and the timing at which the second sound wave signal is input to the output device 123 is 10 pec or more, so the output device 123 can reliably discriminate and output the first sound wave signal and the second sound wave signal.

Since the timings at which the first sound wave signal and the second sound wave signal are input to the output device 123 differ from each other, the output device 123 may combine the first sound wave signal and the second sound wave signal being inputted and output the combined signal instead of switching the output signal. However, by switching the output signal, the output device 123 can output the first sound wave signal and the second sound wave signal without interfering them even when the first sound wave signal and the second sound wave signal are input in a partially overlapped state.

In this way, since the distance D1 between the first sound wave emitter 115*a* and the first sound wave receiver 115*b* differs from the distance D2 between the second sound wave emitter 116*a* and the second sound wave receiver 116*b*, the output device 123 outputs the first sound wave signal and the second sound wave signal at different timings. Due to this, a processing circuit can utilize the first sound wave signal and the second sound wave signal to properly determine the state of the medium.

The sound wave signal amplifier 124 is one example of an amplifier and includes a sound wave signal amplifying circuit. The sound wave signal amplifier 124 amplifies the first sound wave signal and the second sound wave signal outputted from the output device 123 and outputs them to the A/D converter 125.

The A/D converter 125 generates digitalized first sound wave signal and second sound wave signal by sampling the analog first sound wave signal and second sound wave signal outputted from the sound wave signal amplifier 124 at regular interval and outputs them to the processing circuit. In other words, the output device 123 outputs the first sound wave signal and the second sound wave signal through the sound wave signal amplifier 124 and the A/D converter 125 to the processing circuit. The sound wave signal amplifier

124 outputs the first sound wave signal and the second sound wave signal through the A/D converter 125 to the processing circuit.

In this way, in the medium conveyance apparatus 100, the drive signal generator 121 to generate the drive signals input to a plurality of sound wave sensors is used in common, and an A/D converter 125 and a processing circuit to process the sound wave signals outputted from the plurality of sound wave sensors are used in common. Therefore, the medium conveyance apparatus 100 can reduce the equipment costs and weight while having a plurality of sound wave sensors.

In general, when a sound wave emitter is driven for a long time, the sound wave emitter will generate heat. Due to the effect of the heat, the waveform of the sound wave outputted from the sound wave emitter will be distorted. For this reason, the period during which the drive signal (pulse) is input to the sound wave emitter is desirably set to as short as possible within a range where the sound wave outputted from the sound wave emitter can be properly detected by a sound wave receiver and where the sound wave signal outputted from the sound wave receiver can be properly processed by a processing circuit. In other words, the length of a sound wave signal outputted from the sound wave receiver is preferably the minimum length which the processing circuit can process. In this case, if a first sound wave signal and a second sound wave signal are simultaneously input to an output device, the output device cannot output the first sound wave signal and the second sound wave signal without interfering with each other and in a state having lengths which the processing circuit can process.

In the medium conveyance apparatus 100, the first sound wave signal and the second sound wave signal are input to the output device 123 at timings different from each other. For this reason, the output device 123 can output the first sound wave signal and the second sound wave signal without interfering with each other and in a state having lengths which the processing circuit can process. Therefore, the processing circuit can determine the state of the medium respectively based on the first sound wave signal and the second sound wave signal.

Figure 4:
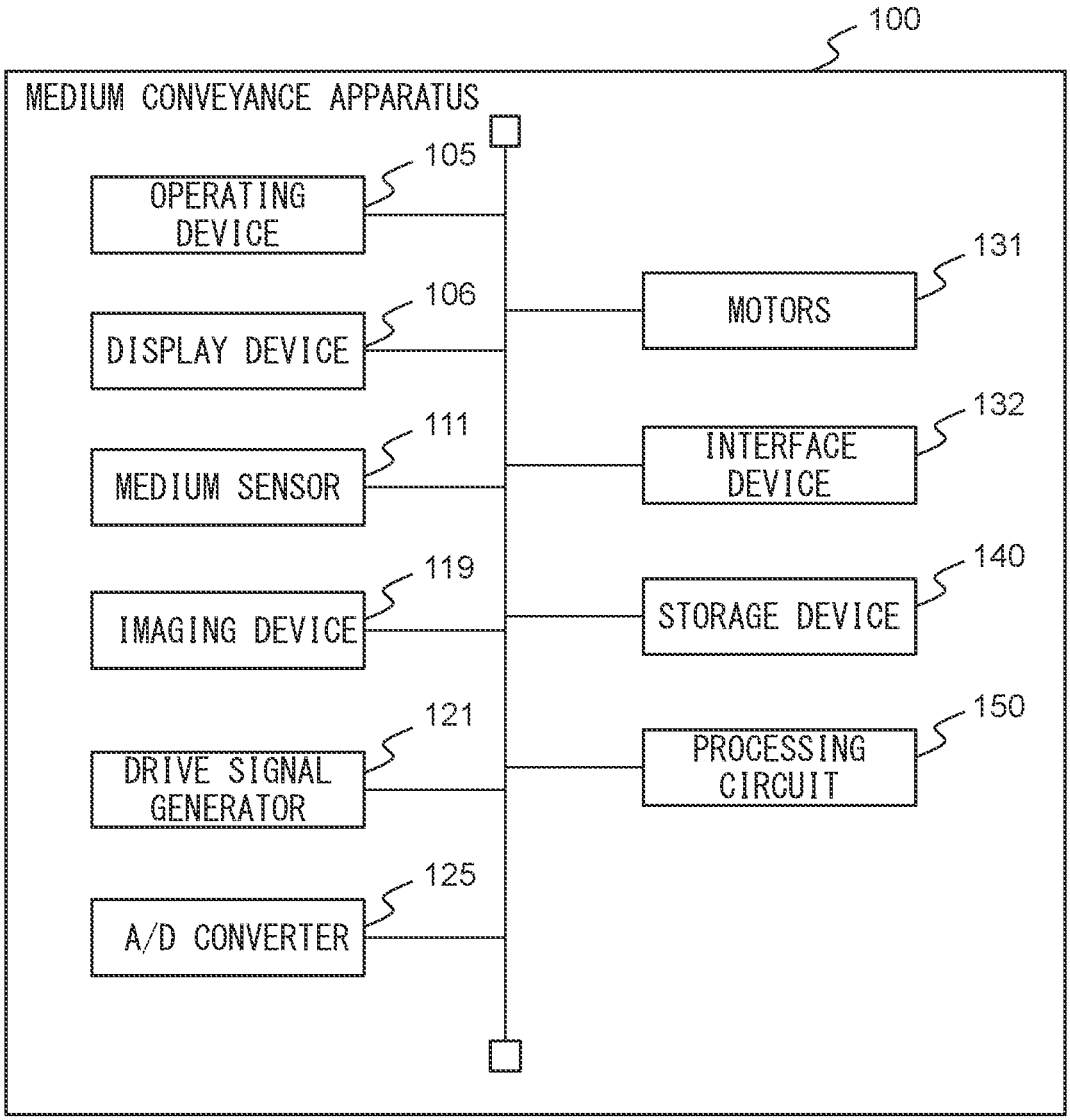
FIG. 4 is a block diagram illustrating the schematic configuration of a medium conveyance apparatus according to an embodiment.

FIG. 4 is a block diagram illustrating the schematic constitution of an example of a medium conveyance apparatus.

In addition to the above-mentioned constitution, the medium conveyance apparatus 100 further has a motor 131, interface device 132, storage device 140, processing circuit 150, etc.

The motors 131 includes one or more motors and rotate the pick roller 112, feed roller 113, separation roller 114, and the first to eighth conveyance rollers 117*a* to 117*h* to feed and convey the medium by control signals from the processing circuit 150. The first to eighth driven rollers 118*a* to 118*h* may be provided so as to rotate with the drive force of the motor 131 instead of driven by the first to eighth conveyance rollers 117*a* to 117*h*.

The interface device 132 has an interface circuit based on, for example a Universal Serial Bus (USB) or other serial bus and is electrically coupled with an information processing apparatus (for example, a personal computer, mobile information terminal, etc.) to send and receive input images and various information. Further, instead of the interface device 132, a communication device having an antenna sending and receiving wireless signals and a wireless communication interface circuit for transmitting and receiving signals through a wireless communication line in accordance with a predetermined communication protocol may be used. The predetermined communication protocol is for example a wireless Local Area Network (LAN).

The storage device 140 has a Random Access Memory (RAM), Read Only Memory (ROM), or other memory device, hard disk or other fixed disk device, flexible disk, optical disk, or other portable storage device, etc. Further, the storage device 140 stores computer programs, databases, tables, etc., used for various processing of the medium feed apparatus 100. The computer programs may be installed on the storage device 140 from a computer-readable, non-transitory medium such as a Compact Disc ROM (CD-ROM), Digital Versatile Disc ROM (DVD-ROM), etc., by using a well-known setup program etc. The computer programs may be installed on the storage device 140 from a server, etc.

The processing circuit 150 operates based on programs stored in advance in the storage device 140. The processing circuit is, for example, a Central Processing Unit (CPU). As the processing circuit 150, a Digital Signal Processor (DSP), Large Scale Integrated Circuit (LSI), Application Specific Integrated Circuit (ASIC), Field-Programmable Gate Array (FPGA), etc., may be used.

The processing circuit 150 is connected to the operating device 105, display device 106, medium sensor 111, imaging device 119, drive signal generator 121, A/D converter 125, motors 131, interface device 132, storage device 140, etc., and controls them. The processing circuit 150 controls the motors 131 to convey the medium, controls the imaging device 119 to acquire the input image, and sends the acquired input image through the interface device 132 to an information processing device. Further, the processing circuit 150 controls the drive signal generator 121 to cause the first sound wave emitter 115*a* and the second sound wave emitter 116*a* to output the sound waves and determines the state of the medium based on the first sound wave signal and the second sound wave signal received from the A/D converter 125.

Figure 5:
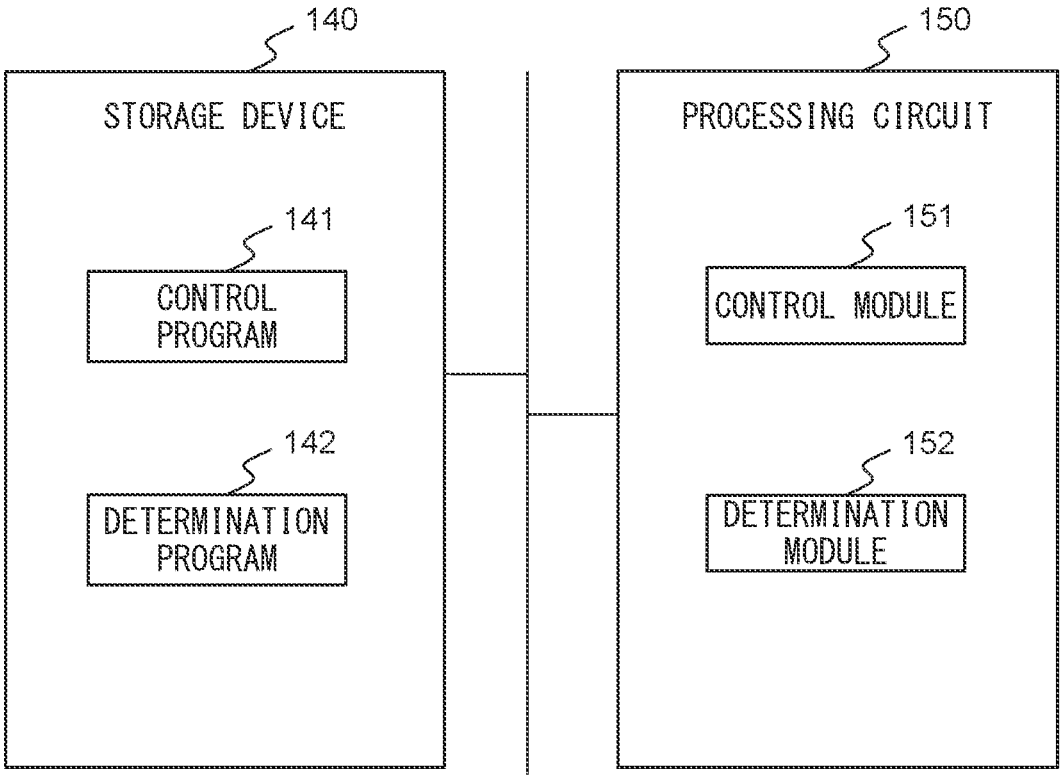
FIG. 5 is a view illustrating the schematic configuration of a storage device and a processing circuit according to an embodiment.

FIG. 5 is a view illustrating the schematic constitution of an example of a storage device and an example of a processing circuit.

As illustrated in FIG. 5, the storage device 140 stores a control program 141 and determination program 142. These programs are function modules loaded by software operating on a processor. The processing circuit 150 reads programs stored in the storage device 140 and operates in accordance with the read programs to thereby function as the control module 151 and the determination module 152.

Figure 6:
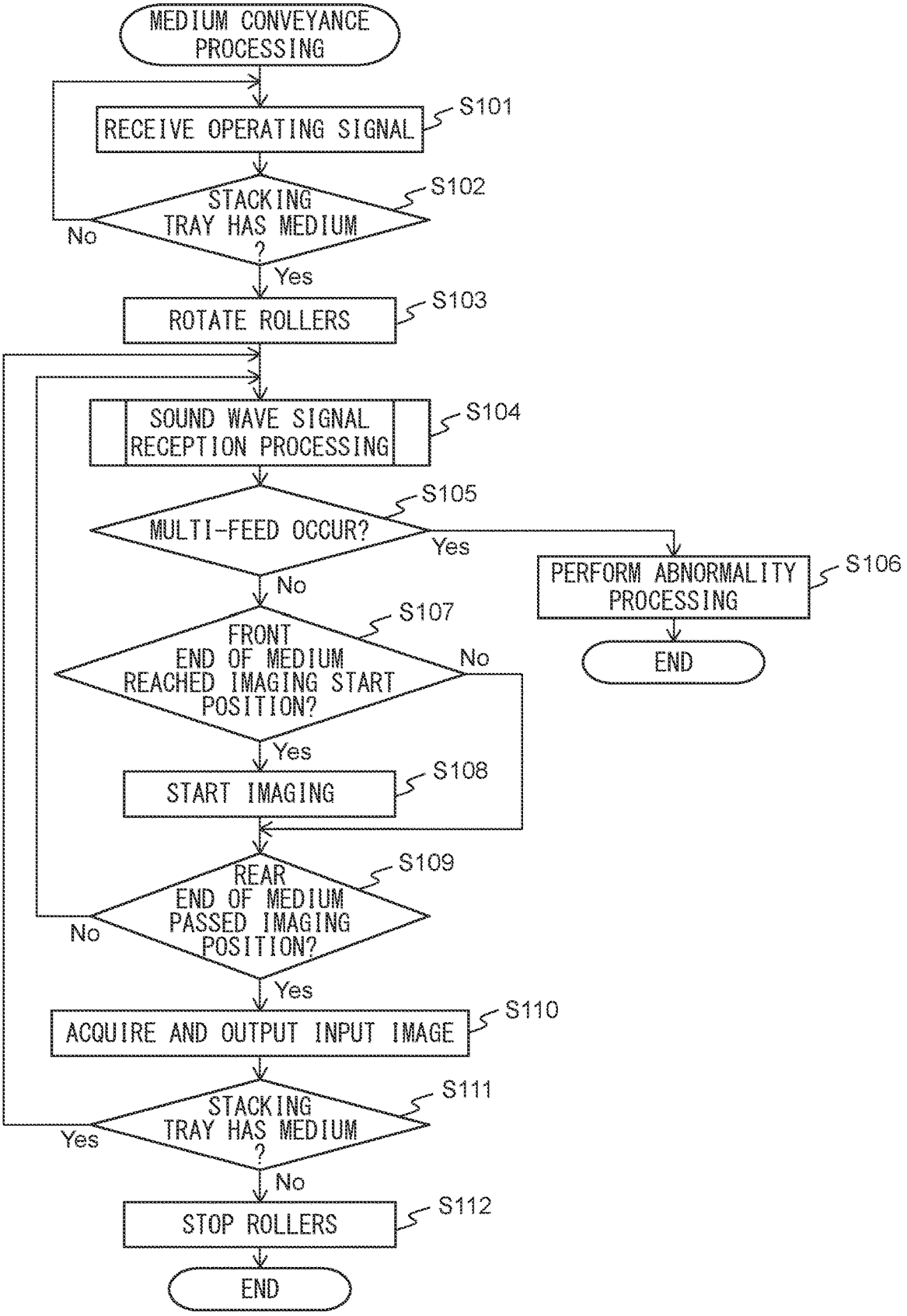
FIG. 6 is a flow chart illustrating an example of operations of medium reading processing.

FIG. 6 is a flow chart presenting an example of the operations in an example of a medium reading processing of an example of a medium conveyance apparatus 100.

An example of the operations in an example of a medium reading processing of an example of a medium feed apparatus will be explained below in reference to the flow chart presented in FIG. 6. Note that, the flow of the operations explained below is performed, based on a program stored in advance in the storage device 140, mainly by the processing circuit 150 in cooperation with the elements of the medium conveyance apparatus 100.

First, the control module 151 waits until an instruction to read a medium is input by a user using the operating device 105 or an information processing apparatus and an operating signal instructing reading of the medium is received from the operating device 105 or interface device 132 (step S101).

Next, the control module 151 acquires a medium signal from the medium sensor 111 and determines whether the stacking tray 103 has the medium based on the acquired medium signal (step S102). When the stacking tray 103 does not have the medium, the control module 151 returns the processing to step S101 and waits until newly receiving an operating signal from the operating device 105 or the interface device 132.

On the other hand, when the stacking tray 103 has the medium, the control module 151 drives the motor for moving the stacking tray 103 to move the stacking tray 103 to a position where the medium can be fed. The control module 151 drives the motors 131 for rotating the pick roller 112, feed roller 113, separation roller 114, first to eighth conveyance rollers 117*a* to 117*h*, and/or first to eighth driven rollers 118*a* to 118*h*. The control module 151 feeds and conveys the medium stacked on the stacking tray 103 (step S103).

Next, the processing circuit 150 performs sound wave signal reception processing (step S104). In the sound wave signal reception processing, the determination module 152 receives the first sound wave signal outputted from the first sound wave receiver 115*b* and the second sound wave signal outputted from the second sound wave receiver 116*b* from the A/D converter 125. The sound wave signal reception processing will be explained later.

Next, the determination module 152 determines whether multi-feed of the medium has occurred, as the state of the medium (step S105). The determination module 152 determines whether multi-feed of the medium has occurred based on the first sound wave signal outputted from the first sound wave receiver 115*b* and the second sound wave signal outputted from the second sound wave receiver 116*b*. The determination module 152 determines that overlap of the medium has occurred at the position of the first sound wave sensor 115 when the magnitude of the sound wave indicated in the first sound wave signal is less than a first sound wave threshold value. On the other hand, the determination module 152 determines that overlap of the medium has not occurred at the position of the first sound wave sensor 115 when the magnitude of the sound wave indicated in the first sound wave signal is the first sound wave threshold value or more. Further, the determination module 152 determines that overlap of the medium has occurred at the position of the second sound wave sensor 116 when the magnitude of the sound wave indicated in the second sound wave signal is less than the second sound wave threshold value. On the other hand, the determination module 152 determines that overlap of the medium has not occurred at the position of the second sound wave sensor 116 when the magnitude of the sound wave indicated in the second sound wave signal is the second sound wave threshold value or more.

Figure 7A:
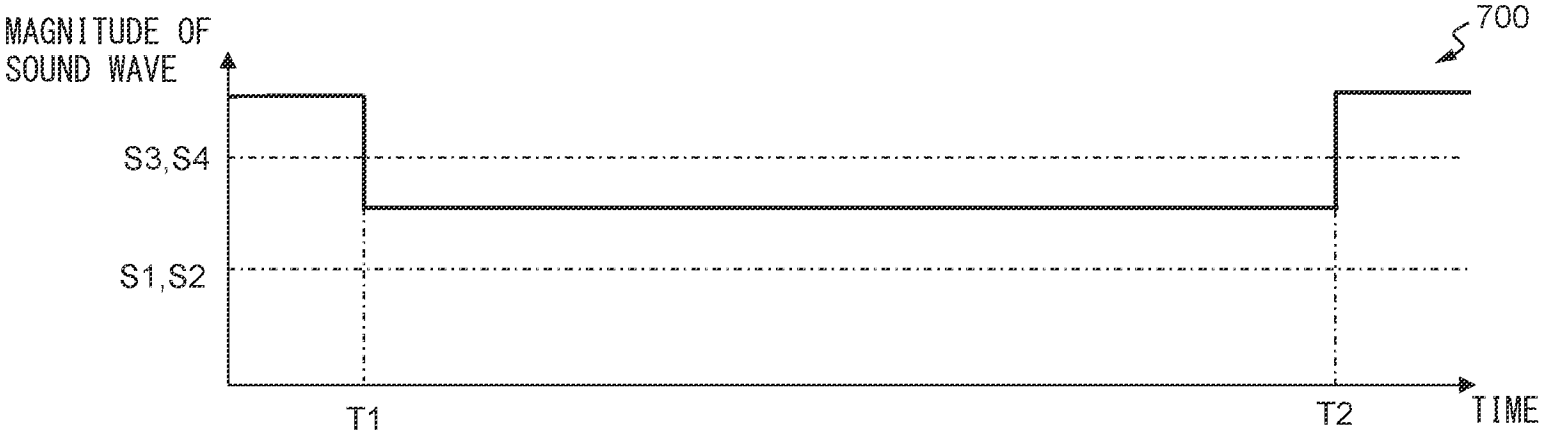
FIG. 7A is a graph indicating characteristics of magnitudes of sound waves.
Figure 7B:
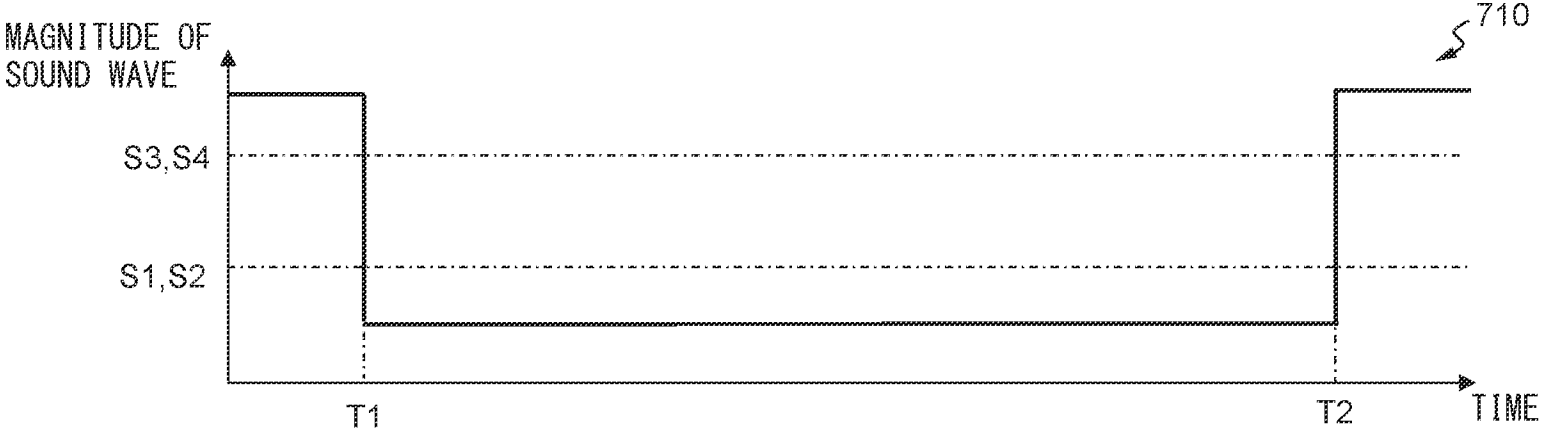
FIG. 7B is a graph indicating characteristics of magnitudes of sound waves.

FIG. 7A and FIG. 7B are graphs 700 and 710 indicating the characteristics of the magnitude of the sound wave indicated in the first sound wave signal. Note that, the characteristics of the second sound wave signal are similar to the characteristics of the first sound wave signal, so, only the characteristics of the first sound wave signal will be explained below as a representative case.

The horizontal axis indicate time, and the vertical axis indicate the magnitude of the sound wave indicated in the first sound wave signal, in the graphs 700 and 710. The graph 700 indicates the magnitude of the sound wave when one sheet of PPC paper is conveyed while the graph 710 indicates the magnitude of the sound wave when two sheets of PPC paper are conveyed in an overlapping manner. In the graphs 700 and 710, the front end of the paper reaches the position of the first sound wave sensor 115 at the time T1, and the rear end of the paper passes through the position of the first sound wave sensor 115 at the time T2. When there is a paper at the position of the first sound wave sensor 115, the sound wave outputted from the first sound wave emitter 115*a* is attenuated by the paper. For this reason, as indicated in the graph 700, when there is the paper at the position of the first sound wave sensor 115, the magnitude of the sound wave is reduced, compared to the case where there is no medium at the position of the first sound wave sensor 115. Further, when there are two sheets of paper at the position of the first sound wave sensor 115, the sound wave outputted from the first sound wave emitter 115*a* is further attenuated by the air layer between the two sheets of paper. For this reason, as indicated in the graph 710, when there are two sheets of paper at the position of the first sound wave sensor 115, the magnitude of the sound wave is reduced compared to the case where there is one sheet of paper at the position of the first sound wave sensor 115.

The first sound wave threshold value S1 is set to a value between the magnitude of the sound wave indicated in the first sound wave signal when there is one sheet of paper at the position of the first sound wave sensor 115 and the magnitude of the sound wave indicated in the first sound wave signal when there are two sheets of paper at the position of the first sound wave sensor 115. Similarly, the second sound wave threshold value S2 is set to a value between the magnitude of the sound wave indicated in the second sound wave signal when there is one sheet of paper present at the position of the second sound wave sensor 116 and the magnitude of the sound wave indicated in the second sound wave signal when there are two sheets of paper present at the position of the second sound wave sensor 116. The determination module 152 can compare magnitudes of the sound waves indicated in the sound wave signals with sound wave threshold values and thereby determine whether overlap of the medium has occurred at the positions of the sound wave sensors.

When there is a paper at the position of a sound wave sensor, the phase of the sound wave outputted from the sound wave emitter will shift due to the paper. For this reason, when there is a paper at the position of the sound wave sensor, the phase shift of the sound wave will increase, compared to the case where there is no medium at the position of the sound wave sensor. Further, when there are two sheets of paper at the position of the sound wave sensor, the phase of the sound wave outputted from the sound wave emitter will greatly shift further due to the air layer between the two sheets of paper. For this reason, when there are two sheets of paper at the position of the sound wave sensor, phase shift of the sound wave will increase, compared to the case where there is one sheet of paper at the position of the sound wave sensor.

Therefore, the determination module 152 may determine whether overlap of the medium has occurred based on the magnitude of the phase shift of the sound wave indicated in the first sound wave signal and the second sound wave signal. In this case, the determination module 152 determines that overlap of the medium has occurred at the position of the first sound wave sensor 115 when the magnitude of the phase shift indicated in the first sound wave signal is greater than a first phase threshold value. On the other hand, the determination module 152 determines that overlap of the medium has not occurred at the position of the first sound wave sensor 115 when the magnitude of the phase shift indicated in the first sound wave signal is the first phase threshold value or less. Further, the determination module 152 determines that overlap of the medium has occurred at the position of the second sound wave sensor 116 when the magnitude of the phase shift indicated in the second sound wave signal is greater than a second phase threshold value. On the other hand, the determination module 152 determines that overlap of the medium has not occurred at the position of the second sound wave sensor 116 when the magnitude of the phase shift indicated in the second sound wave signal is the second phase threshold value or less.

The first phase threshold value is set to a value between the magnitude of the phase shift indicated in the first sound wave signal when there is one sheet of paper at the position of the first sound wave sensor 115 and the magnitude of the phase shift indicated in the first sound wave signal when there are two sheets of paper at the position of the first sound wave sensor 115. The second phase threshold value is set to a value between the magnitude of the phase shift indicated in the second sound wave signal when there is one sheet of paper at the position of the second sound wave sensor 116 and the magnitude of the phase shift indicated in the second sound wave signal when there are two sheets of paper at the position of the second sound wave sensor 116. In this case, the determination module 152 can properly determine whether overlap of the medium has occurred.

Further, the determination module 152 may determine whether overlap of the medium has occurred based on both of the magnitude of the sound wave and the magnitude of the phase shift of the sound wave. For example, the determination module 152 determines that overlap of the medium has occurred when both of the magnitude of a sound wave and phase shift of a sound wave indicate that overlap of the medium has occurred, and determines that overlap of the medium has not occurred when either indicates that overlap of the medium has not occurred. In this case, the determination module 152 determines that overlap of the medium has occurred at the position of the first sound wave sensor 115 when the magnitude of the sound wave indicated in the first sound wave signal is less than the first sound wave threshold value and the magnitude of the phase shift is greater than the first phase threshold value. On the other hand, the determination module 152 determines that overlap of the medium has not occurred at the position of the first sound wave sensor 115 when the magnitude of the sound wave indicated in the first sound wave signal is the first sound wave threshold value or more or when the magnitude of the phase shift is the first phase threshold value or less. Further, the determination module 152 determines that overlap of the medium has occurred at the position of the second sound wave sensor 116 when the magnitude of the sound wave indicated in the second sound wave signal is less than the second sound wave threshold value and the magnitude of the phase shift is larger than the second phase threshold value. On the other hand, the determination module 152 determines that overlap of the medium has not occurred at the position of the second sound wave sensor 116 when the magnitude of the sound wave indicated in the second sound wave signal is the second sound wave threshold value or more or the magnitude of the phase shift is the second phase threshold value or less. In this case, the determination module 152 can determine whether overlap of the medium has occurred more precisely.

Further, the determination module 152 may change the first sound wave threshold value and the second sound wave threshold value respectively based on the magnitude of the phase shift indicated in the first sound wave signal and the magnitude of the phase shift indicated in the second sound wave signal. For example, the determination module 152 sets the first sound wave threshold value in the case of the magnitude of the phase shift indicated in the first sound wave signal is larger than the first phase threshold value to a value larger than the first sound wave threshold value in the case of the magnitude is the first phase threshold value or less. Further, the determination module 152 sets the second sound wave threshold value in the case of the magnitude of the phase shift indicated in the second sound wave signal is larger than the second phase threshold value to a value larger than the second sound wave threshold value in the case of the magnitude is the second phase threshold value or less. In this case, the determination module 152 can determine whether overlap of the medium has occurred more precisely.

The determination module 152 determines that multi-feed of the medium has occurred when overlap of the medium has occurred at least at one of the position of the first sound wave sensor 115 and the position of the second sound wave sensor 116. On the other hand, the determination module 152 determines that multi-feed of the medium has not occurred when overlap of the medium has not occurred at both of the position of the first sound wave sensor 115 and the position of the second sound wave sensor 116. The determination module 152 may also determine that a medium with an attachment is conveyed and multi-feed of the medium has not occurred when overlap of the medium has occurred at one of the position of the first sound wave sensor 115 and the position of the second sound wave sensor 116 and overlap of the medium has not occurred at the other.

When the determination module 152 determines that multi-feed of the medium has occurred, the control module 151 performs abnormality processing (step S106) and ends the series of steps. As abnormality processing, the control module 151 stops the motors 131 to stop feed and conveyance of the medium by the conveying unit. Further, as abnormality processing, the control module 151 displays information indicating that multi-feed of the medium has occurred on the display device 106 or sends it through the interface device 132 to an information processing device to notify the user. As abnormality processing, the control module 151 may also stop the medium reading processing after ejecting the medium currently being conveyed. Further, as abnormality processing, the control module 151 may also drive the motors 131 to control the conveying unit to convey the medium reversely, return to the stacking tray 103, and then re-feed. The user is no longer required to restack the medium on the stacking tray 103 and re-feed. The control module 151 can improve user friendliness.

On the other hand, when it is determined that multi-feed of the medium has not occurred the at step S105, determination module 152 determines whether the front end of the medium has reached the imaging start position as the state of the medium (step S107). The determination module 152 determines whether the front end of the medium has reached the imaging start position based on the first sound wave signal outputted from the first sound wave receiver 115*b* and the second sound wave signal outputted from the second sound wave receiver 116*b*.

The determination module 152 determines that the front end of the medium has reached the position of the first sound wave sensor 115 when the magnitude of the sound wave indicated in the first sound wave signal received last time is larger than a third sound wave threshold value and the magnitude of the sound wave indicated in the first sound wave signal received this time is the third sound wave threshold value or less. The determination module 152 determines that the front end of the medium has reached the position of the second sound wave sensor 116 when the magnitude of the sound wave indicated in the second sound wave signal received last time is larger than a fourth sound wave threshold value and the magnitude of the sound wave indicated in the second sound wave signal received this time is the fourth sound wave threshold value or less.

As indicated in FIG. 7A and FIG. 7B, the third sound wave threshold value S3 and the fourth threshold value sound wave S4 are respectively set to values larger than the first sound wave threshold value S1 and the second sound wave threshold value S2. The third sound wave threshold value S3 is set to a value between the magnitude of the sound wave indicated in the first sound wave signal in the case where there is no paper at the position of the first sound wave sensor 115 and the magnitude of the sound wave indicated in the first sound wave signal in the case where there is one sheet of paper at the position of the first sound wave sensor 115. The fourth sound wave threshold value S4 is set to a value between the magnitude of the sound wave indicated in the second sound wave signal in the case where there is no paper at the position of the second sound wave sensor 116 and the magnitude of the sound wave indicated in the second sound wave signal in the case where there is one sheet of paper at the position of the second sound wave sensor 116.

The determination module 152 may determine whether the front end of the medium has reached the position of the first sound wave sensor 115 and whether the front end of the medium has reached the position of the second sound wave sensor 116 based on the magnitude of the phase shift of the sound wave indicated in the first sound wave signal and the second sound wave signal. In this case, the determination module 152 determines that the front end of the medium has reached the position of the first sound wave sensor 115 when the magnitude of the phase shift indicated in the first sound wave signal received last time is less than a third phase threshold value and the magnitude of the phase shift indicated in the first sound wave signal received this time is the third phase threshold value or more. Further, the determination module 152 determines that the front end of the medium has reached the position of the second sound wave sensor 116 when the magnitude of the phase shift indicated in the second sound wave signal received last time is less than a fourth phase threshold value and the magnitude of the phase shift indicated in the second sound wave signal received this time is the fourth phase threshold value or more.

The third phase threshold value and the fourth phase threshold value are respectively set to values smaller than the first phase threshold value and the second phase threshold value. The third phase threshold value is set to a value between the magnitude of the phase shift indicated in the first sound wave signal in the case where there is no paper at the position of the first sound wave sensor 115 and the magnitude of the phase shift indicated in the first sound wave signal in the case where there is one sheet of paper at the position of the first sound wave sensor 115. The fourth phase threshold value is set to a value between the magnitude of the phase shift indicated in the second sound wave signal in the case where there is no paper at the position of the second sound wave sensor 116 and the magnitude of the phase shift indicated in the second sound wave signal in the case where there is one sheet of paper at the position of the second sound wave sensor 116.

Further, the determination module 152 may determine whether the front end of the medium has reached the position of a sound wave sensor based on both of the magnitude of a sound wave and the magnitude of phase shift of a sound wave. For example, the determination module 152 determines that the front end of the medium has reached the position of a sound wave sensor when either of the magnitude of the sound wave and the phase shift of the sound wave indicates the medium is present and determines that the medium has not reached the position of the sound wave sensor when both indicate that the medium is not present. In this case, the determination module 152 can determine whether the front end of the medium has reached the position of a sound wave sensor more precisely.

The determination module 152 may change the third sound wave threshold value and the fourth sound wave threshold value based on the respective magnitude of the phase shift indicated in the first sound wave signal and the magnitude of the phase shift indicated in the second sound wave signal. For example, the determination module 152 sets the third sound wave threshold value in the case of the magnitude of the phase shift indicated in the first sound wave signal is greater than the third phase threshold value to a value larger than the third sound wave threshold value in the case of the magnitude is the third phase threshold value or less. Further, the determination module 152 sets the fourth sound wave threshold value in the case of the magnitude of the phase shift indicated in the second sound wave signal is greater than the fourth phase threshold value to a value larger than the fourth sound wave threshold value in the case where the magnitude is the fourth phase threshold value or less. In this case, the determination module 152 can determine whether the front end of the medium has reached the position of a sound wave sensor more precisely.

The determination module 152 determines that the front end of the medium has reached an imaging start position when the front end of the medium has reached at least one of the position of the first sound wave sensor 115 and the position of the second sound wave sensor 116 or when a first predetermined time period elapsed after that. The first predetermined time period is set to the time period required for the medium to move from the position of the first sound wave sensor 115 or the position of the second sound wave sensor 116 to a predetermined position at the upstream side of the imaging device 119.

Further, the determination module 152 may use a second medium sensor different from the first sound wave sensor 115 and the second sound wave sensor 116 to determine whether the front end of the medium has reached the imaging start position. In this case, the second medium sensor is located at any position at the downstream side of the feed roller 113 and separation roller 114 and the upstream side of the imaging device 119. For example, the second medium sensor includes a light emitter and light receiver provided at one side with respect to the medium conveyance path and a light guide provided at a position facing the light emitter and light receiver with the medium conveyance path in between. The light emitter is an LED (light emitting diode), etc., and emits light toward the medium conveyance path. On the other hand, the light receiver is a photodiode, etc., and receives light emitted from the light emitter and guided by the light guide. The second medium sensor generates and outputs a second medium signal with a signal value changing between a state where there is the medium at the position of the medium sensor and a state where there is no medium based on the intensity of the light received by the light receiver.

The determination module 152 determines that the front end of the medium has reached the position of the second medium sensor when the signal value of the second medium signal changes from a value indicating a state where there is no medium to a state where there is the medium. The determination module 152 determines that the front end of the medium has reached the imaging start position when the front end of the medium reaches the position of the second medium sensor or when a second predetermined time period has elapsed after that. The second predetermined time period is set to the time period required for the medium to move from the position of the second medium sensor to a predetermined position at the upstream side of the imaging device 119. Further, the determination module 152 may determine that the front end of the medium has reached the imaging start position when a predetermined time period has elapsed from when feed of the medium is started.

When the front end of the medium has still not reached the imaging start position, the control module 151 moves the processing to step S109 without performing any particular processing.

On the other hand, when the front end of the medium has reached the imaging start position, the control module 151 controls the imaging device 119 to start capturing the medium (step S108).

Next, the determination module 152 determines whether the rear end of the medium has passed through the imaging position as the state of the medium (step S109). The determination module 152 determines whether the rear end of the medium has passed through the imaging position based on the first sound wave signal outputted from the first sound wave receiver 115*b* and the second sound wave signal outputted from the second sound wave receiver 116*b*.

The determination module 152 determines that the rear end of the medium has passed through the position of the first sound wave sensor 115 when the magnitude of the sound wave indicated in the first sound wave signal received last time is the third sound wave threshold value or less and the magnitude of the sound wave indicated in the first sound wave signal received this time is larger than the third sound wave threshold value. Further, the determination module 152 determines that the rear end of the medium has passed through the position of the second sound wave sensor 116 when the magnitude of the sound wave indicated in the second sound wave signal received last time is the fourth sound wave threshold value or less and the magnitude of the sound wave indicated in the second sound wave signal received this time is larger than the fourth sound wave threshold value.

The determination module 152 may also determine whether the rear end of the medium has passed through the position of the first sound wave sensor 115 and whether the rear end of the medium has passed through the position of the second sound wave sensor 116 based on the magnitude of the phase shift of the sound wave indicated in the first sound wave signal and the second sound wave signal. In this case, the determination module 152 determines that the front end of the medium has reached the position of the first sound wave sensor 115 when the magnitude of the phase shift indicated in the first sound wave signal received last time is the third phase threshold value or more and the magnitude of the phase shift indicated in the first sound wave signal received this time is less than the third phase threshold value. Further, the determination module 152 determines that the front end of the medium has reached the position of the second sound wave sensor 116 when the magnitude of the phase shift indicated in the second sound wave signal received last time is the fourth phase threshold value or more and the magnitude of the phase shift indicated in the second sound wave signal received this time is less than the fourth sound wave threshold value.

Further, the determination module 152 may determine the rear end of the medium has passed through the position of a sound wave sensor based on both the magnitude of the sound wave and the magnitude of the phase shift of the sound wave. For example, the determination module 152 determines that medium has passed through the position of a sound wave sensor when both the magnitude of the sound wave and the phase shift of the sound wave indicate that there is no medium and determines that the medium has not passed through the position of a sound wave sensor when either indicates that there is the medium. In this case, the determination module 152 can determine whether the rear end of the medium has passed through a sound wave sensor more precisely.

The determination module 152 determines that the rear end of the medium has passed through the imaging position when a third predetermined time has elapsed from when the rear end of the medium has passed through both the position of the first sound wave sensor 115 and the position of the second sound wave sensor 116. The third predetermined time is set to the time period required for the medium to move from the position of the first sound wave sensor 115 or the position of the second sound wave sensor 116 to the imaging position of the imaging device 119.

Further, the determination module 152 may use the second medium sensor to determine whether the rear end of the medium has passed through the imaging position. In this case, the determination module 152 determines that the rear end of the medium has passed through the position of the second medium sensor when the signal value of the second medium signal has changed from a value indicating the state where there is the medium to a state where there is no medium. The determination module 152 determines that the rear end of the medium has passed through the imaging position when a fourth predetermined time has elapsed from when the rear end of the medium passed the position of the second medium sensor. The fourth predetermined time is set to the time period required for the medium to move from the position of the second medium sensor to the imaging position of the imaging device 119. Further, the determination module 152 may determine that the rear end of the medium has passed through the imaging position when a predetermined time period has elapsed from when feed of the medium is started.

When the rear end of the medium has still not passed through the imaging position, the control module 151 returns the processing to step S104 and repeats the processing of step S104 and the subsequent processing.

On the other hand, when the rear end of the medium has passed through the imaging position, the control module 151 determines that the entire medium has been captured. The control module 151 acquires the input image from the imaging device 119 and outputs the acquired input image by sending it through the interface device 132 to an information processing device (step S110).

Next, the control module 151 determines whether there is any medium remaining on the stacking tray 103 based on the medium signal received from the medium sensor 111 (step S111). When the medium remains on the stacking tray 103, the control module 151 returns the processing to step S104 and repeats the processing of step S104 and the subsequent processing.

On the other hand, when there is no medium on the stacking tray 103, the control module 151 stops the motors 131. The control module 151 stops the pick roller 112, feed roller 113, separation roller 114, the first to the eighth conveyance rollers 117*a* to 117*h*, and/or the first to the eighth driven rollers 118*a* to 118*h* (step S112). The control module 151 ends the series of steps.

The processing of steps S105 to S106 may be omitted and the determination module 152 need not determine whether multi-feed of the medium has occurred as the state of the medium.

Further, the determination module 152 may determine whether jamming of the medium has occurred as the state of the medium. The determination module 152 determines whether jamming of the medium has occurred based on the first sound wave signal outputted from the first sound wave receiver 115*b* and the second sound wave signal outputted from the second sound wave receiver 116*b*. The determination module 152 determines that jamming of the medium has occurred when the front end of the medium has not reached either of the position of the first sound wave sensor 115 and the position of the second sound wave sensor 116 within a predetermined time period from starting feed of the medium. When it is determined by the determination module 152 that jamming of the medium has occurred, as abnormality processing, the control module 151 stops the motors 131 to stop the feed and conveyance of the medium by the conveying unit. Further, as abnormality processing, the control module 151 displays information indicating that jamming of the medium has occurred on the display device 106 or sends it through the interface device 132 to an information processing device to notify the user. The medium conveyance apparatus 100 can avoid damaging the medium by continuously applying a load to the medium when jamming of the medium has occurred.

Further, the determination module 152 may also determine whether skew of the medium has occurred as the state of the medium. The determination module 152 determines whether skew of the medium has occurred based on the first sound wave signal outputted from the first sound wave receiver 115*b* and the second sound wave signal outputted from the second sound wave receiver 116*b*. The determination module 152 determines that skew of the medium has occurred when the front end of the medium has not reached the one of the position of the first sound wave sensor 115 and the position of the second sound wave sensor 116 within a predetermined time period after reaching the other. When the determination module 152 determines that skew of the medium has occurred, the control module 151 stops the motors 131 to stop the feed and conveyance of the medium by the conveying unit as abnormality processing. Further, as abnormality processing, the control module 151 displays information indicating that skew of the medium has occurred on the display device 106 or sends it through the interface device 132 to an information processing device to notify the user. The medium conveyance apparatus 100 can suppress that the medium is damaged by striking a side wall of the conveyance path when skew of the medium has occurred.

Figure 8:
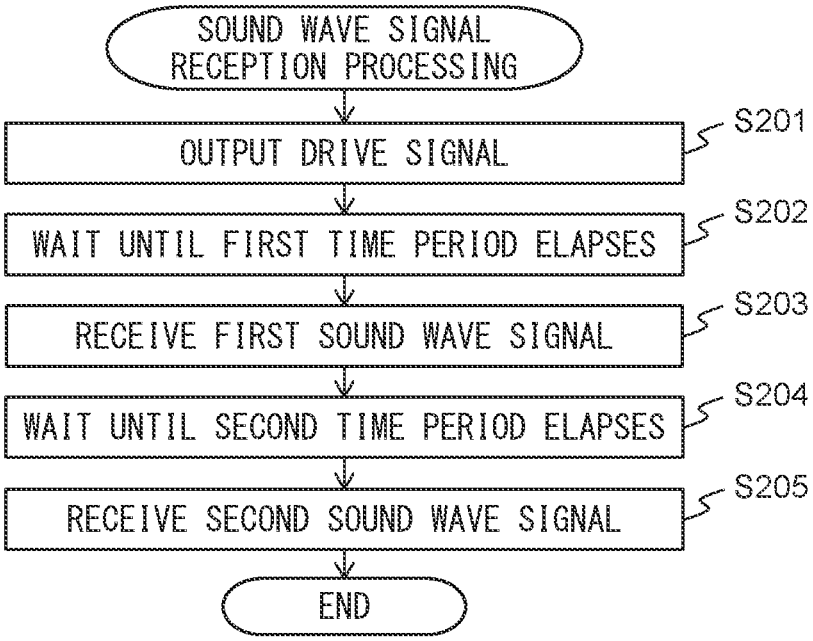
FIG. 8 is a flow chart illustrating an example of sound wave signal reception processing.

FIG. 8 is a flow chart illustrating an example of the operations in sound wave signal reception processing. The flow of operations illustrated in FIG. 8 is performed at step S104 of the flow chart illustrated in FIG. 6.

First, the control module 151 controls the drive signal generator 121 to output drive signals for a predetermined period. The control module 151 drives the first sound wave sensor 115 and the second sound wave sensor 116 for the predetermined period to cause the first sound wave emitter 115*a* and the second sound wave emitter 116*a* to output the sound waves (step S201). The predetermined period may be set to a shorter period than the time difference between the timing at which the output device 123 receives the first sound wave signal generated based on the drive signal outputted at the predetermined timing and the timing at which the output device 123 receives the second sound wave signal generated based on that drive signal. The predetermined period is, for example, set to a time period of less than 10 use.

Next, the determination module 152 waits until a first time period elapses from when the control module 151 controlled the drive signal generator 121 to output the drive signal (step S202). The first time period is set in advance to the time period from when the control module 151 controls the drive signal generator 121 to output the drive signal to when the A/D converter 125 outputs the first sound wave signal generated based on that drive signal.

Next, the determination module 152 receives the signal outputted from the A/D converter 125. The determination module 152 receives the first sound wave signal generated based on the drive signal outputted from the drive signal generator 121 at step S201 (step S203).

Next, the determination module 152 waits until a second time period elapses from when the control module 151 outputs a drive signal to the drive signal generator 121 (step S204). The second time period is set in advance to the time period from when the control module 151 controls the drive signal generator 121 to output a drive signal to when the second sound wave signal generated based on that drive signal is output by the A/D converter 125.

Next, the determination module 152 receives the signal outputted from the A/D converter 125. Due to this, the determination module 152 receives the second sound wave signal generated based on the drive signal outputted from the drive signal generator 121 at step S201 (step S205) and ends the series of steps.

As explained in detail above, by outputting the sound wave signals outputted from a plurality of sound wave sensors at different timings, the medium conveyance apparatus 100 is able to use one drive system for driving the sound wave sensors and one signal processing system for processing the sound wave signals outputted from the sound wave sensors controlled by a single drive signal. The medium conveyance apparatus 100 can utilize a common drive signal generator 121 and A/D converter 125 for the plurality of sound wave sensors and can suppress an increase in the part costs. Further, the medium conveyance apparatus 100 can drive the plurality of sound wave sensors all together by controlling a single drive signal generator 121, and acquire a plurality of sound wave signals outputted from the plurality of sound wave sensors from the single A/D converter 125. Therefore, the medium conveyance apparatus 100 can simplify the drive processing system of the sound wave sensors and the signal processing of the sound wave signals outputted from the sound wave sensors and suppress an increase in the development costs relating to each processing. Therefore, the medium conveyance apparatus 100 can suppress an increase in the equipment costs while precisely determining the state of the medium.

In particular, in the medium conveyance apparatus 100, the distance D1 between the first sound wave emitter 115*a* and the first sound wave receiver 115*b* differs from the distance D2 between the second sound wave emitter 116*a* and the second sound wave receiver 116*b*. The medium conveyance apparatus 100 outputs the sound wave signals at timings different from each other. The medium conveyance apparatus 100 can determine the state of the medium using the sound wave signals without having special parts for differentiating the output timings of the sound wave signals, and can better suppress an increase in the equipment costs.

Figure 9:
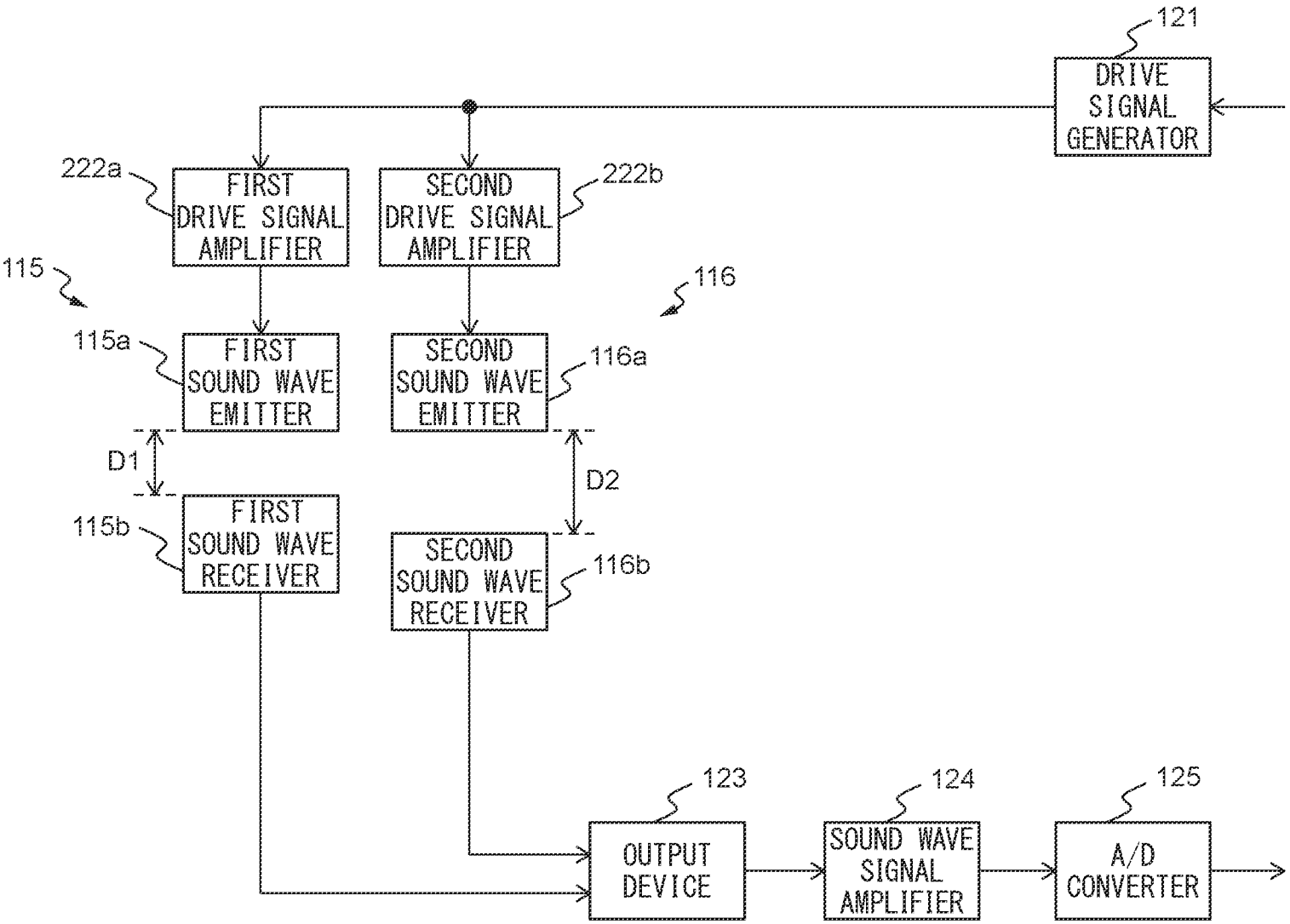
FIG. 9 is a schematic view for explaining a plurality of drive signal amplifiers.

FIG. 9 is a schematic view for explaining a first drive signal amplifier 222*a* and a second drive signal amplifier 222*b* in a medium conveyance apparatus according to another embodiment.

The medium conveyance apparatus according to the present embodiment has the parts of the medium conveyance apparatus 100. However, as illustrated in FIG. 9, the medium conveyance apparatus according to the present embodiment has a first drive signal amplifier 222*a* and second drive signal amplifier 222*b* instead of the drive signal amplifier 122. The drive signal generator 121 respectively outputs drive signals to the first drive signal amplifier 222*a* and the second drive signal amplifier 222*b*.

The first drive signal amplifier 222*a* is one example of the first amplifier and includes a first drive signal amplifying circuit. The first drive signal amplifier 222*a* amplifies the drive signal outputted from the drive signal generator 121 and outputs it to the first sound wave emitter 115*a*. The second drive signal amplifier 222*b* is one example of the second amplifier and includes a second drive signal amplifying circuit. The second drive signal amplifier 222*b* amplifies the drive signal outputted from the drive signal generator 121 and outputs it to the second sound wave emitter 116*a*.

The medium conveyance apparatus 100 amplifies the drive signals input from the first sound wave emitter 115*a* and the second sound wave emitter 116*a* using a single drive signal amplifier 122, so can reduce the number of parts of the medium conveyance apparatus 100 and can reduce the equipment weight and costs. However, the medium conveyance apparatus 100 distributes the drive signal outputted from the drive signal amplifier 122 to input to both of the first sound wave emitter 115*a* and the second sound wave emitter 116*a*. The drive signal is attenuated when distributed, so the drive signal amplifier 122 has to greatly amplify the drive signal considering the amount of attenuation. When greatly amplifying the drive signals, the waveform of the drive signal may be distorted and the amount of occurrence of electromagnetic interference (EMI) of the drive signal may increase.

The medium conveyance apparatus according to the present embodiment amplifies the drive signal to be input to the first sound wave emitter 115*a* and the second sound wave emitter 116*a* using separate drive signal amplifiers, so the medium conveyance apparatus needs not to distribute the drive signal amplified using the drive signal amplifiers. For this reason, the drive signal amplifiers can amplify the drive signal to suitable magnitude and can improve the quality of the waveforms of the drive signal and reduce the amounts of occurrence of EMI regarding the drive signal.

As explained in detail above, the medium conveyance apparatus can suppress an increase in the equipment costs while precisely determining the state of the medium even when amplifying the drive signal to be input to the first sound wave emitter 115*a* and the second sound wave emitter 116*a* using separate drive signal amplifiers.

Figure 10:
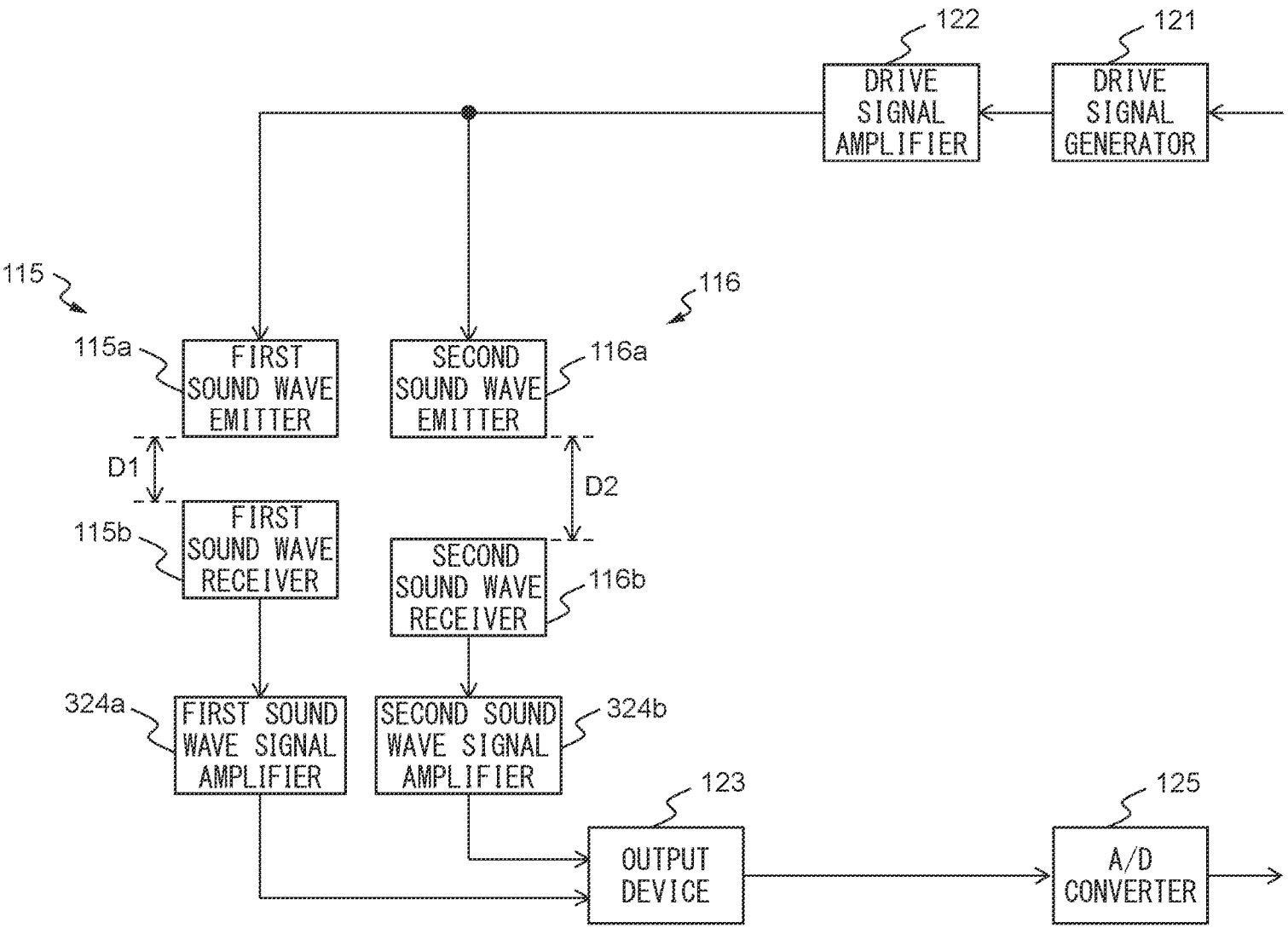
FIG. 10 is a schematic view for explaining a plurality of sound wave signal amplifiers.

FIG. 10 is a schematic view for explaining the first sound wave signal amplifier 324*a* and the second sound wave signal amplifier 324*b* in the medium conveyance apparatus according to still another embodiment.

The medium conveyance apparatus according to the present embodiment has the parts of the medium conveyance apparatus 100. However, as illustrated in FIG. 10, the medium conveyance apparatus according to the present embodiment has a first sound wave signal amplifier 324*a* and a second sound wave signal amplifier 324*b* instead of the sound wave signal amplifier 124. The first sound wave receiver 115*b* outputs a first sound wave signal to the first sound wave signal amplifier 324*a* while the second sound wave receiver 116*b* outputs a second sound wave signal to the second sound wave signal amplifier 324*b*.

The first sound wave signal amplifier 324*a* is one example of the first amplifier and includes a first sound wave signal amplifying circuit. The first sound wave signal amplifier 324*a* amplifies the first sound wave signal outputted from the first sound wave receiver 115*b* to output to the output device 123. The second sound wave signal amplifier 324*b* is one example of the second amplifier and includes a first sound wave signal amplifying circuit. The second sound wave signal amplifier 324*b* amplifies the second sound wave signal outputted from the second sound wave receiver 116*b* to output it to the output device 123. The output device 123 receives the first sound wave signal outputted from the first sound wave signal amplifier 324*a* and the second sound wave signal outputted from the second sound wave signal amplifier 324*b* as input. The output device 123 switches the signal to be output and outputs either of the first sound wave signal outputted from the first sound wave signal amplifier 324*a* and the second sound wave signal outputted from the second sound wave signal amplifier 324*b* to the A/D converter 125. Further, the output device 123 combines the first sound wave signal and second sound wave signal to output to the A/D converter 125.

The medium conveyance apparatus 100 amplifies the first sound wave signal and the second sound wave signal to be input to the A/D converter 125 using a single sound wave signal amplifier 124. The medium conveyance apparatus 100 can reduce the number of parts of the medium conveyance apparatus 100 and reduce the equipment weight and costs. However, the sound wave signal amplifier 124 amplifies the first sound wave signal and the second sound wave signal switched and outputted at predetermined timings by the output device 123, so noise introduced at the time of switching the signal by the output device 123 may also be amplified. On the other hand, in the medium conveyance apparatus according to the present embodiment, the first sound wave signal amplifier 324*a* and the second sound wave signal amplifier 324*b* amplify the first sound wave signal and the second sound wave signal before inputting them to the output device 123, so the noise introduced at the time of switching the signal by the output device 123 is not amplified. The medium conveyance apparatus according to the present embodiment can improve the quality of the first sound wave signal and the second sound wave signal.

Further, in the medium conveyance apparatus according to the present embodiment, each sound wave signal amplifier is located between each sound wave signal receiver and the output device 123. So, the distance of the signal lines between each sound wave signal receiver and each sound wave signal amplifier is shorter. The noise introduced on each signal line between each sound wave signal receiver and each sound wave signal amplifier and input to the sound wave signal amplifiers is smaller. Therefore, the medium conveyance apparatus according to the present embodiment can suppress amplification of noise and improve the quality of the first sound wave signal and the second sound wave signal.

In the present embodiment, the first drive signal amplifier 222*a* and the second drive signal amplifier 222*b* may be used instead of the drive signal amplifier 122.

As explained in detail above, the medium conveyance apparatus can suppress an increase in the equipment costs while precisely determining the state of the medium even when amplifying the first sound wave signal and the second sound wave signal using separate sound wave signal amplifiers.

Figure 11:
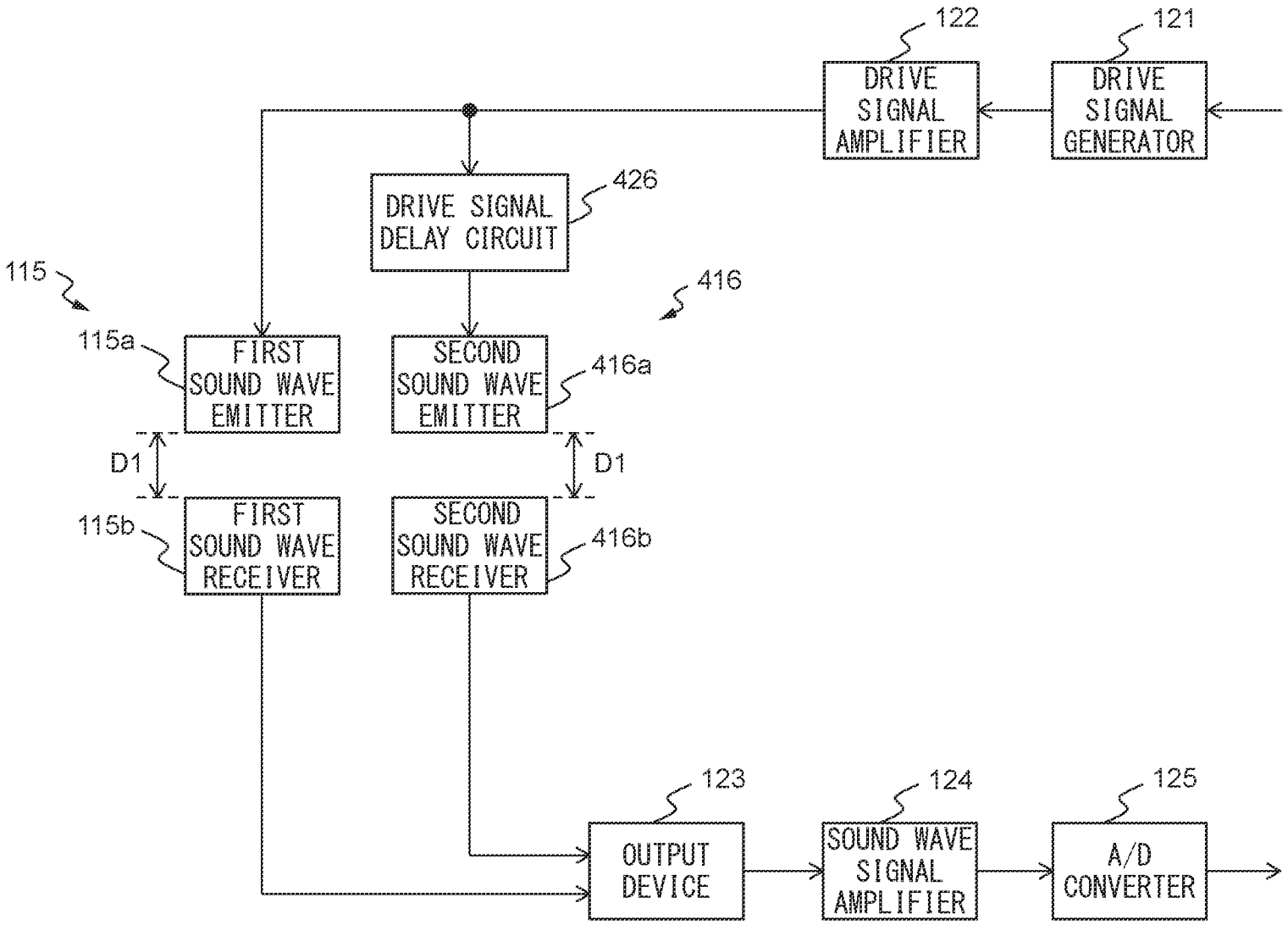
FIG. 11 is a schematic view for explaining a drive signal delay circuit according to an embodiment.

FIG. 11 is a schematic view for explaining a drive signal delay circuit 426 in a medium conveyance apparatus according to still another embodiment.

The medium conveyance apparatus according to the present embodiment has the parts of the medium conveyance apparatus 100. However, as illustrated in FIG. 11, the medium conveyance apparatus according to the present embodiment has a second sound wave sensor 416 instead of the second sound wave sensor 116 and further has a drive signal delay circuit 426. The second sound wave sensor 416 includes a second sound wave emitter 416*a* and a second sound wave receiver 416*b*. The drive signal amplifier 122 outputs an amplified drive signal to the first sound wave emitter 115*a* and the drive signal delay circuit 426.

The drive signal delay circuit 426 is one example of the signal delay circuit. The drive signal delay circuit 426 is a delay circuit including capacitors, resistors, etc., and is located between the drive signal amplifier 122 (signal distribution part to the first sound wave emitter 115*a* and the second sound wave emitter 416*a*) and the second sound wave emitter 416*a*. The drive signal delay circuit 426 delays the drive signal input from the drive signal amplifier 122 by exactly a predetermined time to output to the second sound wave emitter 416*a*. The predetermined time is set to, for example, 10 usec.

The second sound wave emitter 416*a* and the second sound wave receiver 416*b* have similar configurations and functions to the second sound wave emitter 116*a* and the second sound wave receiver 116*b*. However, the second sound wave sensor 416 is located such that the distance between the second sound wave emitter 416*a* and the second sound wave receiver 416*b* is equal to the distance D1 between the first sound wave emitter 115*a* and the first sound wave receiver 115*b*.

The drive signal delay circuit may be located between the drive signal amplifier 122 (signal distribution part) and the first sound wave emitter 115*a*, and delay the drive signal input from the drive signal amplifier 122 and output to the first sound wave emitter 115*a*. As illustrated in FIG. 9, when the first drive signal amplifier 222*a* and the second drive signal amplifier 222*b* are provided, the drive signal delay circuit may be located between the drive signal generator 121 (signal distribution part) and the second drive signal amplifier 222*b*, and delay the drive signal input from the drive signal generator 121 and output to the second drive signal amplifier 222*b*. Further, the drive signal delay circuit may be located between the second drive signal amplifier 222*b* and the second sound wave emitter 416*a*, and delay the drive signal input from the second drive signal amplifier 222*b* and output to the second drive signal amplifier 222*b*. Further, the drive signal delay circuit may be located between the drive signal generator 121 (signal distribution part) and the first drive signal amplifier 222*a*, and delay the drive signal input from the drive signal generator 121 and output to the first drive signal amplifier 222*a*. Further, the drive signal delay circuit may be located between the first drive signal amplifier 222*a* and the first sound wave emitter 115*a*, and delay the drive signal input from the first sound wave emitter 115*a* and output to the first sound wave emitter 115*a*.

In the medium conveyance apparatus according to the present embodiment, the drive signal delay circuit is provided between the drive signal generator 121 and the first sound wave emitter or the second sound wave emitter, so the output device 123 outputs the first sound wave signal and the second sound wave signal to the processing circuit 150 at timings different from each other. The medium conveyance apparatus can reduce the effect of manufacturing error of the positions of arrangement of the sound wave sensors, etc., and set the time difference of the first sound wave signal and the second sound wave signal reliably and with a high precision. Further, in the medium conveyance apparatus, the distances between the sound wave emitters and sound wave receivers of the sound wave sensors are the same. Therefore, design and mounting can be easier.

In the present embodiment, the first sound wave signal amplifier 324*a* and the second sound wave signal amplifier 324*b* may be used instead of the sound wave signal amplifier 124.

As explained in detail above, the medium conveyance apparatus can suppress an increase in the equipment costs while precisely determining the state of the medium even when using a drive signal delay circuit to delay the drive signal.

Figure 12:
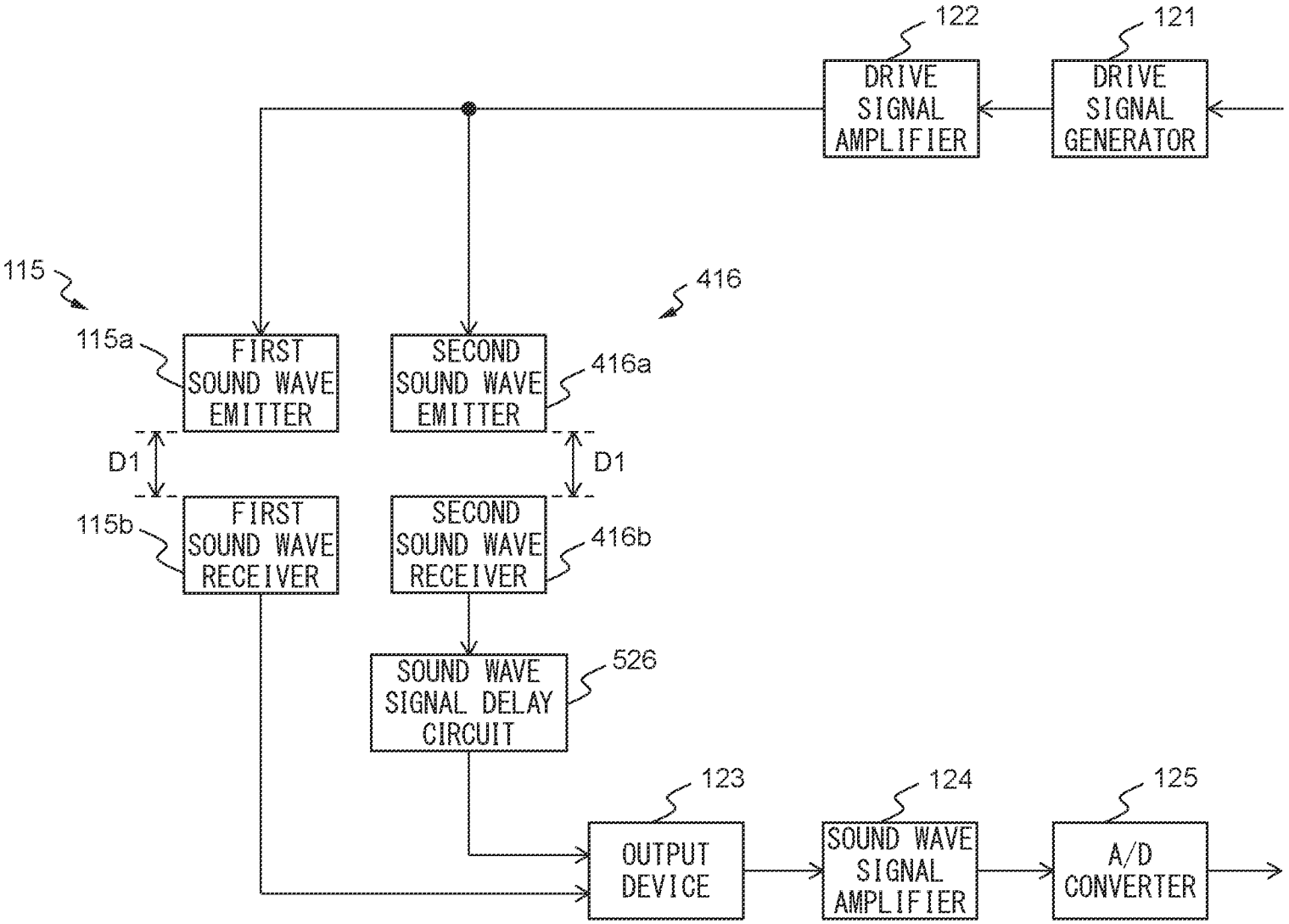
FIG. 12 is a schematic view for explaining a sound wave signal delay circuit according to an embodiment.

FIG. 12 is a schematic view for explaining a sound wave signal delay circuit 526 in a medium conveyance apparatus according to still another embodiment.

The medium conveyance apparatus according to the present embodiment has the parts of the medium conveyance apparatus 100. However, as illustrated in FIG. 12, the medium conveyance apparatus according to the present embodiment has the second sound wave sensor 416 instead of the second sound wave sensor 116, and further has the sound wave signal delay circuit 526.

The sound wave signal delay circuit 526 is one example of the signal delay circuit. The sound wave signal delay circuit 526 is a delay circuit including capacitors, resistors, etc., and is located between the second sound wave receiver 416*b* and the output device 123. The second sound wave receiver 416*b* outputs the second sound wave signal to the sound wave signal delay circuit 526. The sound wave signal delay circuit 526 delays the sound wave signal input from the second sound wave receiver 416*b* by exactly a predetermined time and outputs to the output device 123. The predetermined time is set to, for example, 10 μsec.

The sound wave signal delay circuit may be located between the first sound wave receiver 115*b* and the output device 123 and delay the drive signal input from the first sound wave receiver 115*b* to output it to the output device 123. As illustrated in FIG. 10, when the first sound wave signal amplifier 324*a* and the second sound wave signal amplifier 324*b* are provided, the sound wave signal delay circuit may be located between the second sound wave receiver 416*b* and the second sound wave signal amplifier 324*b*, and delay the sound wave signal input from the second sound wave receiver 416*b* and output to the second sound wave signal amplifier 324*b*. Further, the sound wave signal delay circuit may be located between the second sound wave signal amplifier 324*b* and the output device 123, and delay the sound wave signal input from the second sound wave signal amplifier 324*b* and output to the output device 123. Further, the sound wave signal delay circuit may be located between the first sound wave receiver 115*b* and the first sound wave signal amplifier 324*a*, and delay the sound wave signal input from the first sound wave receiver 115*b* and output to the first sound wave signal amplifier 324*a*. Further, the sound wave signal delay circuit may be located between the first sound wave signal amplifier 324*a* and the output device 123, and delay the sound wave signal input from the first sound wave signal amplifier 324*a* and output to the output device 123.

In the medium conveyance apparatus according to the present embodiment, a sound wave signal delay circuit is provided between the first sound wave receiver or the second sound wave receiver and the output device, so the output device 123 outputs the first sound wave signal and the second sound wave signal to the processing circuit 150 at timings different from each other. The medium conveyance apparatus can reduce the effect of manufacturing error of the positions of arrangement of the sound wave sensors, etc., and set the time difference of the first sound wave signal and the second sound wave signal reliably and precisely. Further, in the medium conveyance apparatus, the distances between the sound wave emitters and sound wave receivers at the sound wave sensors are the same, so design and mounting can be easier.

In the present embodiment, the first drive signal amplifier 222*a* and the second drive signal amplifier 222*b* may be used instead of the drive signal amplifier 122.

As explained in detail above, the medium conveyance apparatus can suppress an increase in the equipment costs while precisely determining the state of the medium even when using the sound wave signal delay circuit to delay the sound wave signals.

Figure 13:
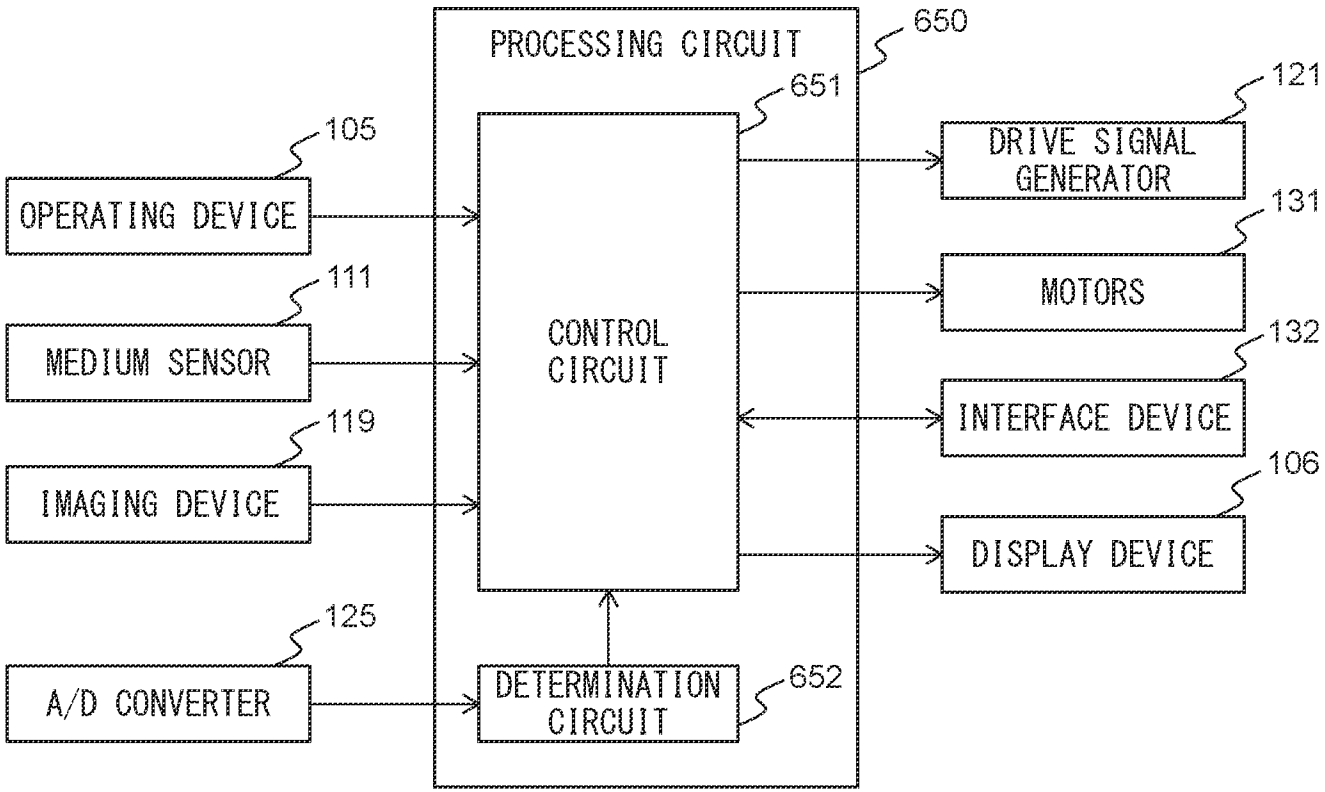
FIG. 13 is a view illustrating a schematic configuration of an example of a processing circuit in a medium conveyance apparatus according to another embodiment.

FIG. 13 is a view illustrating a schematic configuration of a processing circuit 650 in the medium conveyance apparatus according to another embodiment.

The processing circuit 650 is used instead of the processing circuit 150 and performs the medium reading processing, etc., instead of the processing circuit 150. The processing circuit 650 has a control circuit 651, determination circuit 652, etc. These parts may be configured by respectively independent integrated circuits, microprocessors, firmware, etc.

The control circuit 651 is one example of the control module and has a similar function to the control module 151. The control circuit 651 receives an operating signal from the operating device 105 or the interface device 132, a medium signal from the medium sensor 111, and the result of determination of the state of the medium from the determination circuit 652 and controls the motors 131 to convey the medium based on the received information. The control circuit 651 acquires the input image from the imaging device 119 and outputs to the interface device 132. Further, the control circuit 651 controls the drive signal generator 121 to output the drive signal.

The determination circuit 652 is one example of the determination module and has a similar function to the determination module 152. The determination circuit 652 receives the first sound wave signal and the second sound wave signal from the A/D converter 125, determines the state of the medium based on the received first sound wave signal and second sound wave signal, and outputs the result of determination to the control circuit 651.

As explained in detail above, the medium conveyance apparatus can suppress an increase in the equipment costs while precisely determining the state of the medium even when using the processing circuit 650.

Although preferred embodiments were explained above, the embodiments are not limited to these. For example, the number of sound wave sensors is not limited to two. Any number of three or more is possible. In this case, each sound wave sensor is located at any position different from each other. Each sound wave sensor is located such that the distance between a sound wave emitter and a sound wave receiver of each sound wave sensor differs from each other. Alternatively, signal delay circuit is provided between the drive signal generator 121 and each sound wave emitter or between each sound wave receiver and the output device 123. The output device 123 is provided to output sound wave signals outputted from the sound wave receivers provided in each sound wave sensor at timings different from each other. The determination module 152 determines the state of the medium based on the sound wave signals outputted from the sound wave sensors.

Further, the medium conveyance apparatus may have a so-called "straight path", and may feed and convey the medium stacked on the stacking tray sequentially from the bottom and eject to the ejection tray. In this case, the separation roller is located above the feed roller to face the feed roller. In this case as well, the medium conveyance apparatus can suppress an increase in the equipment costs while precisely determining the state of the medium.

According to the present invention, the medium conveyance apparatus, determination method, and control program can suppress an increase in the equipment costs while precisely determining the state of the medium.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a presentation of the superiority and inferiority of the invention. Although the embodiment(s) of the present inventions have been described in detail, it should be understood that the various changes, substitutions, and alterations could be made hereto without departing from the spirit and scope of the invention.

What is claimed is:

1. A medium conveyance apparatus comprising:

a conveying roller to convey a medium along a conveyance path;

a first sound wave emitter to output a sound wave including an audible sound or ultrasonic wave;

a first sound wave receiver located to face the first sound wave emitter with the conveyance path in between to output a first sound wave signal corresponding to a received sound wave;

a second sound wave emitter to output a sound wave including an audible sound or ultrasonic wave;

a second sound wave receiver located to face the second sound wave emitter with the conveyance path in between to output a second sound wave signal corresponding to a received sound wave; and a processor to determine a state of the medium based on the first sound wave signal and the second sound wave signal, wherein a distance between the first sound wave emitter and the first sound wave receiver differs from a distance between the second sound wave emitter and the second sound wave receiver, and wherein the first sound wave emitter and the second sound wave emitter are located spaced apart in a direction intersecting with a medium conveyance direction, or the first sound wave receiver and the second sound wave receiver are located spaced apart in the direction intersecting with the medium conveyance direction.

2. The medium conveyance apparatus according to claim 1, further comprising an output circuit to output the first sound wave signal and the second sound wave signal to the processor at timings different from each other.

3. The medium conveyance apparatus according to claim 2, further comprising a drive signal output circuit to output a drive signal for outputting the sound wave from the first sound wave emitter and the second sound wave emitter at a predetermined timing, wherein a signal delay circuit is provided between the drive signal output circuit and the first sound wave emitter or the second sound wave emitter, or between the first sound wave receiver or the second sound wave receiver and the output circuit such that the output circuit outputs the first sound wave signal and the second sound wave signal to the processor at timings different from each other.

4. The medium conveyance apparatus according to claim 3, further comprising one amplifier to amplify the drive signal outputted from the drive signal output circuit and output to the first sound wave emitter and the second sound wave emitter.

5. The medium conveyance apparatus according to claim 3, further comprising:

a first amplifier to amplify the drive signal outputted from the drive signal output circuit and output to the first sound wave emitter; and a second amplifier to amplify the drive signal outputted from the drive signal output circuit and output to the second sound wave emitter.

6. The medium conveyance apparatus according to claim 2, further comprising one amplifier to amplify the first sound wave signal and the second sound wave signal outputted from the output circuit and output to the processor.

7. The medium conveyance apparatus according to claim 2, further comprising:

a first amplifier to amplify the first sound wave signal outputted from the first sound wave receiver and output to the output circuit; and a second amplifier to amplify the second sound wave signal outputted from the second sound wave receiver and output to the output circuit.

8. The medium conveyance apparatus according to claim 1, wherein the processor determines both multi-feed of the medium and a position of the medium based on the first sound wave signal and the second sound wave signal.

9. The medium conveyance apparatus according to claim 1, wherein the processor determines a position at which multi-feed of the medium has occurred based on the first sound wave signal and the second sound wave signal.

10. A medium conveyance method comprising:

determining a state of a medium based on a first sound wave signal outputted according to a received sound wave by a first sound wave receiver located to face a first sound wave emitter with a conveyance path in between, wherein the first sound wave emitter outputs a sound wave including an audible sound or ultrasonic wave, and a second sound wave signal outputted according to a received sound wave by a second sound wave receiver located to face a second sound wave emitter with the conveyance path in between, wherein the second sound wave emitter outputs a sound wave including an audible sound or ultrasonic wave, wherein a distance between the first sound wave emitter and the first sound wave receiver differs from a distance between the second sound wave emitter and the second sound wave receiver, and wherein the first sound wave emitter and the second sound wave emitter are located spaced apart in a direction intersecting with a medium conveyance direction, or the first sound wave receiver and the second sound wave receiver are located spaced apart in the direction intersecting with the medium conveyance direction.

11. The method according to claim 10, wherein the first sound wave signal and the second sound wave signal are outputted by an output circuit at timings different from each other.

12. The method according to claim 11, wherein a drive signal for outputting the sound wave from the first sound wave emitter and the second sound wave emitter is outputted by a drive signal output circuit at a predetermined timing, and wherein a signal delay circuit is provided between the drive signal output circuit and the first sound wave emitter or the second sound wave emitter, or between the first sound wave receiver or the second sound wave receiver and the output circuit such that the first sound wave signal and the second sound wave signal are outputted by the output circuit at timings different from each other.

13. The method according to claim 12, wherein the drive signal outputted from the drive signal output circuit is amplified by one amplifier and outputted to the first sound wave emitter and the second sound wave emitter.

14. The method according to claim 12, wherein the drive signal outputted from the drive signal output circuit is amplified by a first amplifier and outputted to the first sound wave emitter, and wherein the drive signal outputted from the drive signal output circuit is amplified by a second amplifier and outputted to the second sound wave emitter.

15. The method according to claim 11, wherein the first sound wave signal and the second sound wave signal outputted from the output circuit are amplified and outputted by one amplifier.

16. A computer-readable, non-transitory medium storing executable instructions for conveying a medium, the executable instructions comprising:

determining a state of a medium based on a first sound wave signal outputted according to a received sound wave by a first sound wave receiver located to face a first sound wave emitter with a conveyance path in between, wherein the first sound wave emitter outputs a sound wave including an audible sound or ultrasonic wave, and a second sound wave signal outputted according to a received sound wave by a second sound wave receiver located to face a second sound wave emitter with the conveyance path in between, wherein the second sound wave emitter outputs a sound wave including an audible sound or ultrasonic wave, wherein a distance between the first sound wave emitter and the first sound wave receiver differs from a distance between the second sound wave emitter and the second sound wave receiver, and wherein the first sound wave emitter and the second sound wave emitter are located spaced apart in a direction intersecting with a medium conveyance direction, or the first sound wave receiver and the second sound wave receiver are located spaced apart in the direction intersecting with the medium conveyance direction.

17. The computer-readable, non-transitory medium according to claim 16, wherein the first sound wave signal and the second sound wave signal are outputted by an output circuit at timings different from each other.

18. The computer-readable, non-transitory medium according to claim 17, wherein a drive signal for outputting the sound wave from the first sound wave emitter and the second sound wave emitter is outputted by a drive signal output circuit at a predetermined timing, and wherein a signal delay circuit is provided between the drive signal output circuit and the first sound wave emitter or the second sound wave emitter, or between the first sound wave receiver or the second sound wave receiver and the output circuit such that the first sound wave signal and the second sound wave signal are outputted by the output circuit at timings different from each other.

19. The computer-readable, non-transitory medium according to claim 18, wherein the drive signal outputted from the drive signal output circuit is amplified by one amplifier and outputted to the first sound wave emitter and the second sound wave emitter.

20. The computer-readable, non-transitory medium according to claim 18, wherein the drive signal outputted from the drive signal output circuit is amplified by a first amplifier and outputted to the first sound wave emitter, and the drive signal outputted from the drive signal output circuit is amplified by a second amplifier and outputted to the second sound wave emitter.

* * * * *